US011757180B2

(12) United States Patent
McCandless et al.

(10) Patent No.: US 11,757,180 B2
(45) **Date of Patent: *Sep. 12, 2023**

(54) SWITCHABLE PATCH ANTENNA

(71) Applicant: Pivotal Commware, Inc., Kirkland, WA (US)

(72) Inventors: Jay Howard McCandless, Alpine, CA (US); Eric James Black, Bothell, WA (US); Isaac Ron Bekker, Los Angeles, CA (US)

(73) Assignee: Pivotal Commware, Inc., Bothell, WA (US)

( * ) Notice: Subject to any disclaimer, the term of this patent is extended or adjusted under 35 U.S.C. 154(b) by 40 days.

This patent is subject to a terminal disclaimer.

(21) Appl. No.: 17/217,882

(22) Filed: Mar. 30, 2021

(65) Prior Publication Data

US 2021/0313677 A1 Oct. 7, 2021

Related U.S. Application Data

(63) Continuation of application No. 16/673,852, filed on Nov. 4, 2019, now Pat. No. 10,971,813, which is a continuation of application No. 16/280,939, filed on Feb. 20, 2019, now Pat. No. 10,468,767.

(51) Int. Cl.
*H01Q 1/52* (2006.01)
*H01Q 1/36* (2006.01)
(Continued)

(52) U.S. Cl.
CPC ..... *H01Q 1/521* (2013.01); *H01Q 1/36* (2013.01); *H01Q 1/364* (2013.01); *H01Q 1/52* (2013.01);
(Continued)

(58) Field of Classification Search
CPC ..... H01Q 1/521; H01Q 1/364; H01Q 1/52; H01Q 9/04; H01Q 1/24; H01Q 1/36
(Continued)

(56) References Cited

U.S. PATENT DOCUMENTS 2,131,108 A 9/1938 Lindenblad
4,464,663 A 8/1984 Lalezari et al.
(Continued)

FOREIGN PATENT DOCUMENTS

CN 102948089 A 2/2013
CN 103700951 A 4/2014
(Continued)

OTHER PUBLICATIONS

Office Communication for U.S. Appl. No. 17/203,255 dated Apr. 26, 2022, pp. 1-17.
(Continued)

*Primary Examiner* — Hai V Tran
(74) *Attorney, Agent, or Firm* — John W. Branch; Branch Partners PLLC

(57) ABSTRACT

A switchable patch antenna comprises a planar conductor having an aperture (hole) formed in the middle of the planar conductor. Radiation of a sinusoidal signal is controlled by comparison of separate impedance values for two components that have separate impedance values. Each of the two components have one end coupled together at the terminal positioned at a center of the aperture and their other ends separately coupled to opposing edges of the aperture. A sinusoidal signal source is also coupled to the terminal positioned at the aperture's center. Further, when the impedance values of both components are substantially equivalent, radiation by the antenna of the provided signal and/or mutual coupling of other signals is disabled. Also, when an impedance value of one of the two components is substantially greater than the other impedance value of the other component, the provided signal is radiated and/or mutual coupling is enabled.

21 Claims, 10 Drawing Sheets

Z1 = Z2

(51) Int. Cl.
*H01Q 9/04* (2006.01)
*H01Q 3/24* (2006.01)
*H01Q 1/24* (2006.01)

(52) U.S. Cl.
CPC ..... *H01Q 3/247* (2013.01); *H01Q 9/04* (2013.01); *H01Q 9/0407* (2013.01); *H01Q 1/24* (2013.01)

(58) Field of Classification Search
USPC ..... 343/700 MS
See application file for complete search history.

(56) References Cited

U.S. PATENT DOCUMENTS 6,133,880 A 10/2000 Grangeat
6,150,987 A 11/2000 Sole et al.
6,529,745 B1 3/2003 Fukagawa et al.
6,680,923 B1 1/2004 Leon
7,084,815 B2 8/2006 Phillips et al.
7,205,949 B2 4/2007 Turner
9,356,356 B2 5/2016 Chang et al.
9,385,435 B2 7/2016 Bily et al.
9,450,310 B2 9/2016 Bily et al.
9,551,785 B1 1/2017 Geer
9,608,314 B1 * 3/2017 Kwon ..... H01Q 1/521
9,635,456 B2 4/2017 Fenichel
9,711,852 B2 7/2017 Chen et al.
9,806,414 B2 10/2017 Chen et al.
9,806,415 B2 10/2017 Chen et al.
9,806,416 B2 10/2017 Chen et al.
9,812,779 B2 11/2017 Chen et al.
9,813,141 B1 11/2017 Marupaduga et al.
9,936,365 B1 4/2018 Elam
9,955,301 B2 4/2018 Markhovsky et al.
10,033,109 B1 7/2018 Gummalla et al.
10,225,760 B1 3/2019 Black
10,277,338 B2 4/2019 Reial et al.
10,313,894 B1 6/2019 Desclos et al.
10,324,158 B2 6/2019 Wang et al.
10,431,899 B2 10/2019 Bily et al.
10,468,767 B1 11/2019 McCandless et al.
10,505,620 B2 12/2019 Ito et al.
10,734,736 B1 8/2020 McCandless et al.
11,069,975 B1 7/2021 Mason et al.
11,190,266 B1 11/2021 Black et al.
11,252,731 B1 2/2022 Levitsky et al.
2002/0196185 A1 12/2002 Bloy
2003/0025638 A1 2/2003 Apostolos
2003/0062963 A1 4/2003 Aikawa et al.
2004/0003250 A1 1/2004 Kindberg et al.
2004/0038714 A1 2/2004 Rhodes et al.
2004/0229551 A1 11/2004 Hulkkonen et al.
2005/0237265 A1 10/2005 Durham et al.
2005/0282536 A1 12/2005 McClure et al.
2006/0025072 A1 2/2006 Pan
2007/0024514 A1 2/2007 Phillips et al.
2007/0147338 A1 6/2007 Chandra et al.
2007/0184828 A1 8/2007 Majidi-Ahy
2007/0202931 A1 8/2007 Lee et al.
2008/0039012 A1 2/2008 McKay et al.
2008/0049649 A1 2/2008 Kozisek et al.
2008/0181328 A1 7/2008 Harel et al.
2009/0153407 A1 * 6/2009 Zhang ..... H01Q 1/243 343/702
2009/0176487 A1 7/2009 DeMarco
2009/0207091 A1 8/2009 Anagnostou et al.
2009/0231215 A1 * 9/2009 Taura ..... H01Q 21/064 343/702
2009/0296938 A1 12/2009 Devanand et al.
2010/0197222 A1 8/2010 Scheucher
2010/0207823 A1 * 8/2010 Sakata ..... H01Q 9/285 343/702
2010/0248659 A1 9/2010 Kawabata
2010/0302112 A1 12/2010 Lindenmeier et al.
2011/0070824 A1 3/2011 Braithwaite
2011/0199279 A1 8/2011 Shen et al.
2011/0292843 A1 12/2011 Gan et al.
2012/0064841 A1 3/2012 Husted et al.
2012/0094630 A1 4/2012 Wisnewski et al.
2012/0194399 A1 8/2012 Bily et al.
2013/0059620 A1 3/2013 Cho
2013/0069834 A1 3/2013 Duerksen
2013/0141190 A1 6/2013 Kitaoka et al.
2013/0231066 A1 9/2013 Zander et al.
2013/0303145 A1 11/2013 Harrang et al.
2013/0324076 A1 12/2013 Harrang
2014/0094217 A1 4/2014 Stafford
2014/0171811 A1 6/2014 Lin et al.
2014/0198684 A1 7/2014 Gravely et al.
2014/0266946 A1 9/2014 Bily et al.
2014/0269417 A1 9/2014 Yu et al.
2014/0293904 A1 10/2014 Dai et al.
2014/0308962 A1 10/2014 Zhang et al.
2014/0349696 A1 11/2014 Hyde et al.
2015/0109178 A1 4/2015 Hyde et al.
2015/0109181 A1 4/2015 Hyde et al.
2015/0116153 A1 4/2015 Chen et al.
2015/0131618 A1 5/2015 Chen
2015/0162658 A1 6/2015 Bowers et al.
2015/0222021 A1 8/2015 Stevenson et al.
2015/0229028 A1 8/2015 Bily et al.
2015/0236777 A1 8/2015 Akhtar et al.
2015/0276926 A1 10/2015 Bowers et al.
2015/0276928 A1 10/2015 Bowers et al.
2015/0288063 A1 10/2015 Johnson et al.
2015/0318618 A1 11/2015 Chen et al.
2015/0372389 A1 12/2015 Chen et al.
2016/0037508 A1 2/2016 Sun
2016/0079672 A1 3/2016 Cerreno
2016/0087334 A1 3/2016 Sayama et al.
2016/0149308 A1 5/2016 Chen et al.
2016/0149309 A1 5/2016 Chen et al.
2016/0149310 A1 5/2016 Chen et al.
2016/0164175 A1 6/2016 Chen et al.
2016/0174241 A1 6/2016 Ansari et al.
2016/0198334 A1 7/2016 Bakshi et al.
2016/0219539 A1 7/2016 Kim et al.
2016/0241367 A1 8/2016 Irmer et al.
2016/0269964 A1 9/2016 Murray
2016/0345221 A1 11/2016 Axmon et al.
2016/0365754 A1 12/2016 Zeine et al.
2016/0373181 A1 12/2016 Black et al.
2017/0118750 A1 4/2017 Kikuma et al.
2017/0127295 A1 5/2017 Black et al.
2017/0127296 A1 5/2017 Gustafsson et al.
2017/0127332 A1 5/2017 Axmon et al.
2017/0155192 A1 6/2017 Black et al.
2017/0155193 A1 6/2017 Black et al.
2017/0187123 A1 6/2017 Black et al.
2017/0187426 A1 6/2017 Su et al.
2017/0194704 A1 7/2017 Chawgo et al.
2017/0195054 A1 7/2017 Ashrafi
2017/0238141 A1 8/2017 Lindoff et al.
2017/0310017 A1 10/2017 Howard
2017/0339575 A1 11/2017 Kim et al.
2017/0367053 A1 12/2017 Noh et al.
2017/0373403 A1 12/2017 Watson
2018/0013193 A1 1/2018 Olsen et al.
2018/0019798 A1 1/2018 Khan et al.
2018/0027555 A1 1/2018 Kim et al.
2018/0066991 A1 3/2018 Mueller et al.
2018/0097286 A1 4/2018 Black et al.
2018/0123692 A1 5/2018 Leiba
2018/0177461 A1 6/2018 Bell et al.
2018/0219283 A1 8/2018 Wilkins et al.
2018/0227035 A1 8/2018 Cheng et al.
2018/0227445 A1 8/2018 Minegishi
2018/0233821 A1 8/2018 Pham et al.
2018/0270729 A1 9/2018 Ramachandra et al.
2018/0301821 A1 10/2018 Black et al.
2018/0337445 A1 11/2018 Sullivan et al.
2018/0368389 A1 12/2018 Adams
2019/0020107 A1 1/2019 Polehn et al.

(56) References Cited

U.S. PATENT DOCUMENTS

| | | | |
|---|---|---|---|
| 2019/0052428 | A1 | 2/2019 | Chu et al. |
| 2019/0053013 | A1 | 2/2019 | Markhovsky et al. |
| 2019/0067813 | A1 | 2/2019 | Igura |
| 2019/0219982 | A1 | 7/2019 | Klassen et al. |
| 2019/0221931 | A1 | 7/2019 | Black et al. |
| 2019/0289482 | A1 | 9/2019 | Black |
| 2019/0336107 | A1 | 11/2019 | Hope Simpson et al. |
| 2020/0008163 | A1 | 1/2020 | Black et al. |
| 2020/0083605 | A1 | 3/2020 | Quarfoth et al. |
| 2020/0137698 | A1 | 4/2020 | Black et al. |
| 2020/0186227 | A1 | 6/2020 | Reider et al. |
| 2020/0205012 | A1 | 6/2020 | Bengtsson et al. |
| 2020/0259552 | A1 | 8/2020 | Ashworth |
| 2020/0313741 | A1 | 10/2020 | Zhu et al. |
| 2020/0366363 | A1 | 11/2020 | Li et al. |
| 2020/0403689 | A1 | 12/2020 | Rofougaran et al. |
| 2021/0067237 | A1 | 3/2021 | Sampath et al. |
| 2021/0234591 | A1 | 7/2021 | Eleftheriadis et al. |
| 2021/0328664 | A1 | 10/2021 | Schwab et al. |
| 2021/0367684 | A1 | 11/2021 | Bendinelli et al. |
| 2021/0368355 | A1 | 11/2021 | Liu et al. |
| 2022/0014933 | A1 | 1/2022 | Moon et al. |
| 2022/0053433 | A1 | 2/2022 | Abedini et al. |

FOREIGN PATENT DOCUMENTS

| | | | |
|---|---|---|---|
| CN | 106572622 | A | 4/2017 |
| CN | 106664124 | A | 5/2017 |
| CN | 106797074 | A | 5/2017 |
| CN | 110034416 | A | 7/2019 |
| EP | 3273629 | A1 | 1/2018 |
| JP | 61-1102 | A | 1/1986 |
| JP | 936656 | A | 2/1997 |
| JP | H09-214418 | A | 8/1997 |
| JP | 2000-111630 | A | 4/2000 |
| JP | 3307146 | B2 | 7/2002 |
| JP | 2004-270143 | A | 9/2004 |
| JP | 3600459 | B2 | 12/2004 |
| JP | 2007081648 | A | 3/2007 |
| JP | 2007306273 | A | 11/2007 |
| JP | 2008-153798 | A | 7/2008 |
| JP | 2009-514329 | A | 4/2009 |
| JP | 2011-507367 | A | 3/2011 |
| JP | 2011-508994 | A | 3/2011 |
| JP | 2012-175189 | A | 9/2012 |
| JP | 2014207626 | A | 10/2014 |
| JP | 2016-139965 | A | 8/2016 |
| JP | 2017-220825 | A | 12/2017 |
| JP | 2018-14713 | A | 1/2018 |
| JP | 2018-173921 | A | 11/2018 |
| JP | 2020-523863 | A | 8/2020 |
| JP | 2020-145614 | A | 9/2020 |
| KR | 10 2016 0113100 | A | 9/2016 |
| WO | 2010104435 | A1 | 9/2010 |
| WO | 2012050614 | A1 | 4/2012 |
| WO | 2012096611 | A2 | 7/2012 |
| WO | 2012161612 | A1 | 11/2012 |
| WO | 2013023171 | A1 | 2/2013 |
| WO | 2015196044 | A1 | 12/2015 |
| WO | 2016044069 | A1 | 3/2016 |
| WO | 2017008851 | A1 | 1/2017 |
| WO | 2017014842 | A1 | 1/2017 |
| WO | 2017193056 | A1 | 11/2017 |
| WO | 2018144940 | A1 | 8/2018 |
| WO | 2018179870 | A1 | 10/2018 |
| WO | 2020095597 | A1 | 5/2020 |

OTHER PUBLICATIONS

Office Communication for U.S. Appl. No. 17/177,131 dated Apr. 27, 2022, pp. 1-14.
International Search Report and Written Opinion for International Patent Application No. PCT/US2022/012613 dated May 10, 2022, pp. 1-8.
International Search Report and Written Opinion for International Patent Application No. PCT/US2022/013942 dated May 10, 2022, pp. 1-8.
Qualcomm Incorporated, "Common understanding of repeaters," 3GPP TSG RAN WG4 #98_e R4-2102829, 2021, https://www.3gpp.org/ftp/tsg_ran/WG4 Radio/TSGR4_98_e/Docs/R4-2102829.zip, Accessed: May 25, 2022, pp. 1-2.
MediaTek Inc., "General views on NR repeater," 3GPP TSG RAN WG4 #98_e R4-2101156, 2021, https://www.3gpp.org/ftp/tsg_ran/WG4_Radio/TSGR4_98_e/Docs/R4-2101156.zip, Accessed: May 25, 2022, pp. 1-4.
Office Communication for U.S. Appl. No. 17/177,145 dated Jun. 3, 2022, pp. 1-5.
Office Communication for U.S. Appl. No. 17/576,832 dated Jul. 13, 2022, pp. 1-15.
Office Communication for U.S. Appl. No. 17/585,418 dated Jul. 22, 2022, pp. 1-6.
Office Communication for U.S. Appl. No. 17/585,418 dated Aug. 4, 2022, pp. 1-2.
Office Communication for U.S. Appl. No. 17/112,940 dated Aug. 9, 2021, pp. 1-20.
International Seaarch Report and Written Opinion for International Patent Application No. PCT/US2021/034479 dated Aug. 10, 2021, pp. 1-7.
Office Communication for U.S. Appl. No. 17/332,136 dated Sep. 2, 2021, pp. 1-9.
Office Communication for Chinese Patent Application No. 201980019925.1 dated Sep. 27, 2021, pp. 1-25.
Office Communication for 17/177,145 dated Oct. 14, 2021, pp. 1-5.
International Search Report and Written Opinion for International Patent Application No. PCT/US2021/043308 dated Nov. 2, 2021, pp. 1-8.
Office Communication for U.S. Appl. No. 17/177,131 dated Nov. 12, 2021, pp. 1-5.
Extended European Search Report for European Patent Application No. 19772471.9 dated Nov. 8, 2021, pp. 1-8.
Office Communication for U.S. Appl. No. 17/177,145 dated Nov. 16, 2021, pp. 1-16.
Office Communication for U.S. Appl. No. 17/177,131 dated Dec. 17, 2021, pp. 1-14.
Office Communication for U.S. Appl. No. 17/112,940 dated Dec. 22, 2021, pp. 1-15.
International Search Report and Written Opinion for International Patent Application No. PCT/US2021/049502 dated Dec. 14, 2021, pp. 1-8.
Office Communication for U.S. Appl. No. 17/469,694 dated Jan. 20, 2022, pp. 1-9.
Office Communication for U.S. Appl. No. 16/730,690 dated Apr. 8, 2021, pp. 1-11.
Office Communication for U.S. Appl. No. 17/177,131 dated Apr. 9, 2021, pp. 1-17.
Vu, Trung Kien et al., "Joint Load Balancing and interference Mitigation in 5G Heterogeneous Networks," IEEE Transactions on Wireless Communications, 2017, vol. 16, No. 9, pp. 6032-6046.
Office Communication for U.S. Appl. No. 17/177,145 dated Apr. 19, 2021, pp. 1-11.
Office Communication for U.S. Appl. No. 17/112,940 dated Jul. 21, 2021, pp. 1-22.
International Search Report and Written Opinion for International Patent Application No. PCT/US2021/026400 dated Jul. 20, 2021, pp. 1-7.
Office Communication for U.S. Appl. No. 17/177,145 dated Aug. 3, 2021, pp. 1-16.
Office Communication for U.S. Appl. No. 17/177,131 dated Aug. 6, 2021, pp. 1-16.
Office Communication for U.S. Appl. No. 15/925,612 dated Jun. 15, 2018, pp. 1-9.
U.S. Appl. No. 14/510,947 filed Oct. 9, 2014, pp. 1-76.
Office Communication for U.S. Appl. No. 16/049,630 dated Oct. 4, 2018, pp. 1-13.
Office Communication for U.S. Appl. No. 15/870,758 dated Oct. 1, 2018, pp. 1-12 .

(56) References Cited

OTHER PUBLICATIONS

Office Communication for U.S. Appl. No. 16/136,119 dated Nov. 23, 2018, pp. 1-12.
Office Communication for U.S. Appl. No. 16/136,119 dated Mar. 15, 2019, pp. 1-8.
Office Communication for U.S. Appl. No. 16/292,022 dated Jun. 7, 2019, pp. 1-13.
Office Communication for U.S. Appl. No. 16/049,630 dated Apr. 12, 2019, pp. 1-13.
Office Communication for U.S. Appl. No. 16/268,469 dated May 16, 2019, pp. 1-16.
Office Communication for U.S. Appl. No. 16/280,939 dated May 13, 2019, pp. 1-22.
Office Communication for U.S. Appl. No. 16/440,815 dated Jul. 17, 2019, pp. 1-16.
Office Communication for U.S. Appl. No. 16/358,112 dated May 15, 2019, pp. 1-17.
International Search Report and Written Opinion for International Application No. PCT/US2019/022942 dated Jul. 4, 2019, pp. 1-12.
International Search Report and Written Opinion for International Application No. PCT/US2019/022987 dated Jul. 2, 2019, pp. 1-13.
Office Communication for U.S. Appl. No. 16/049,630 dated Jun. 24, 2019, pp. 1-5.
Office Communication for U.S. Appl. No. 16/280,939 dated Jul. 18, 2019, pp. 1-7.
Office Communication for U.S. Appl. No. 16/049,630 dated Aug. 7, 2019, pp. 1-13.
Office Communication for U.S. Appl. No. 16/292,022 dated Sep. 23, 2019, pp. 1-9.
Office Communication for U.S. Appl. No. 16/440,815 dated Oct. 7, 2019, pp. 1-5.
Office Communication for U.S. Appl. No. 16/268,469 dated Sep. 10, 2019, pp. 1-11.
International Search Report and Written Opinion for International Application No. PCT/US2019/041053 dated Aug. 27, 2019, pp. 1-8.
Office Communication for U.S. Patent Application No. 16/568,096 mailed Oct. 24, 2019, pp. 1-10.
International Search Report and Written Opinion for International Application No. PCT/US2019/047093 dated Oct. 21, 2019, pp. 1-7.
Office Communication for U.S. Appl. No. 16/049,630 dated Dec. 9, 2019, pp. 1-13.
Office Communication for U.S. Appl. No. 16/440,815 dated Jan. 8, 2020, pp. 1-8.
Office Communication for U.S. Appl. No. 16/730,932 dated Mar. 6, 2020, pp. 1-13.
Office Communication for U.S. Appl. No. 16/049,630 dated Mar. 31, 2020, pp. 1-15.
Office Communication for U.S. Appl. No. 16/734,195 dated Mar. 20, 2020, pp. 1-8.
Office Communication for U.S. Appl. No. 16/846,670 dated Jun. 11, 2020, pp. 1-12.
Office Communication for U.S. Appl. No. 16/673,852 dated Jun. 24, 2020, pp. 1-11.
International Search Report and Written Opinion for Application No. PCT/US2020/016641 dated Apr. 14, 2020, pp. 1-7.
International Search Report and Written Opinion for Application No. PCT/US2020/013713 dated Apr. 21, 2020, pp. 1-8.
Office Communication for U.S. Appl. No. 16/049,630 dated Aug. 19, 2020, pp. 1-18.
Office Communication for U.S. Appl. No. 16/730,932 dated Aug. 25, 2020, pp. 1-5.
Office Communication for U.S. Appl. No. 16/983,927 dated Aug. 31, 2020, pp. 1-7.
Office Communication for U.S. Appl. No. 16/983,978 dated Sep. 16, 2020, pp. 1-7.
Office Communication for U.S. Appl. No. 16/049,630 dated Oct. 15, 2020, pp. 1-16.
Office Communication for U.S. Appl. No. 16/983,978 dated Oct. 27, 2020, pp. 1-13.
International Search Report and Written Opinion for Application No. PCT/US2020/048806 dated Nov. 17, 2020, pp. 1-9.
Office Communication for U.S. Appl. No. 16/673,852 dated Nov. 25, 2020, pp. 1-8.
Office Communication for U.S. Appl. No. 16/846,670 dated Nov. 25, 2020, pp. 1-13.
Office Communication for U.S. Appl. No. 16/983,927 dated Jan. 6, 2021, pp. 1-8.
Office Communication for U.S. Appl. No. 16/846,670 dated Feb. 8, 2021, pp. 1-4.
Office Communication for U.S. Appl. No. 16/983,978 dated Feb. 10, 2021, pp. 1-11.
Office Communication for U.S. Appl. No. 16/846,670 dated Apr. 2, 2021, pp. 1-9.
International Search Report and Written Opinion for International Patent Application No. PCT/US2021/034479 dated Aug. 10, 2021, pp. 1-7.
Office Communication for U.S. Appl. No. 17/177,145 dated Oct. 14, 2021, pp. 1-5.
Office Communication for U.S. Appl. No. 17/177,131 dated Nov. 16, 2021, pp. 1-16.
Black, Eric J., "Holographic Beam Forming and MIMO," Pivotal Commware, 2017, pp. 1-8.
Björn, Ekman, "Machine Learning for Beam Based Mobility Optimization in NR," Master of Science thesis in Communication Systems, Department of Electrical Engineering, Linköping University, 2017, pp. 1-85.
Office Communication for 102948089 U.S. Appl. No. 17/112,940 dated Dec. 22, 2021, pp. 1-15.
Office Communication for U.S. Appl. No. 17/537,233 dated Feb. 4, 2022, pp. 1-9.
Office Communication for U.S. Appl. No. 17/112,940 dated Mar. 17, 2022, pp. 1-16.
Office Communication for U.S. Appl. No. 17/576,832 dated Mar. 18, 2022, pp. 1-15.
Office Communication for U.S. Appl. No. 17/177,145 dated Mar. 24, 2022, pp. 1-18.
Office Communication for U.S. Appl. No. 17,306,361 dated Mar. 28, 2022, p. 1-7.
Extended European Search Report for European Patent Application No. 19844867.2 dated Mar. 30, 2022, pp. 1-16.
Office Communication for U.S. Appl. No. 17/576,832 dated Apr. 1, 2022, pp. 1-14.
Office Communication for U.S. Appl. No. 17/585,418 dated Apr. 8, 2022, pp. 1-9.
Office Communication for U.S. Appl. No. 17/537,233 dated Apr. 20, 2022, pp. 1-9.
Yurduseven, Okan et al., "Dual-Polarization Printed Holographic Multibeam Metasurface Antenna" Aug. 7, 2017, IEEE Antennas and Wireless Propagation Letters. PP. 10.1109/LAWP.2017, pp. 1-4.
Office Communication for U.S. Appl. No. 16/292,022 dated Aug. 7, 2019, pp. 1-13.
Office Communication for U.S. Appl. No. 16/568,096 dated Oct. 24, 2019, pp. 1-10.
Office Communication for U.S. Appl. No. 16/673,852 mailed Jun. 24, 2020, pp. 1-11.
Gao, S.S. et al., "Holographic Artificial Impedance Surface Antenna Based on Circular Patch", 2018 International Conference on Microwave and Millimeter Wave Technology (ICMMT), 2018, pp. 1-3.
Nishiyama, Eisuke et al., "Polarization Controllable Microstrip Antenna using Beam Lead PIN Diodes", 2006 Asia-Pacific Microwave Conference, 2006, pp. 1-4.
Office Communication for U.S. Appl. No. 17/306,361 dated Sep. 9, 2022, pp. 1-7.
Office Communication for U.S. Appl. No. 17/576,832 dated Sep. 23, 2022, pp. 1-5.
Office Communication for U.S. Appl. No. 17/306,361 dated Sep. 27, 2022, pp. 1-7.
Office Communication for U.S. Appl. No. 17/379,813 dated Oct. 5, 2022, pp. 1-11.
Office Communication for U.S. Appl. No. 17/397,442 dated Oct. 27, 2022, pp. 1-8.

(56) References Cited

OTHER PUBLICATIONS

Office Communication for U.S. Appl. No. 17/859,632 dated Oct. 27, 2022, pp. 1-12.
International Search Report and Written Opinion for International Patent Application No. PCT/US2022/036381 dated Oct. 25, 2022, pp. 1-8.
Extended European Search Report for European Patent Application No. 20759272.6 dated Nov. 3, 2022, pp. 1-9.
Office Communication for U.S. Appl. No. 17/334,105 dated Nov. 30, 2022, pp. 1-7.
Office Communication for U.S. Appl. No. 17/576,832 dated Dec. 15, 2022, pp. 1-15.
Falconer, David D. et al., "Coverage Enhancement Methods for LMDS," IEEE Communications Magazine, Jul. 2003, vol. 41, Iss. 7, pp. 86-92.
Office Communication for U.S. Appl. No. 17/708,757 dated Jan. 20, 2023, pp. 1-5.
Office Communication for U.S. Appl. No. 17/379,813 dated Feb. 3, 2023, pp. 1-10.
Office Communication for U.S. Appl. No. 17/112,895 dated Feb. 6, 2023, pp. 1-8.
Office Communication for U.S. Appl. No. 17/379,813 dated Feb. 15, 2023, pp. 1-3.
Office Communication for U.S. Appl. No. 17/859,632 dated Feb. 28, 2023, pp. 1-13.
International Search Report and Written Opinion for International Patent Application No. PCT/US2022/047909 dated Feb. 21, 2023, pp. 1-7.
Office Communication for Japanese Patent Application No. JP 2020-548724 dated Mar. 8, 2023, pp. 1-9.

* cited by examiner

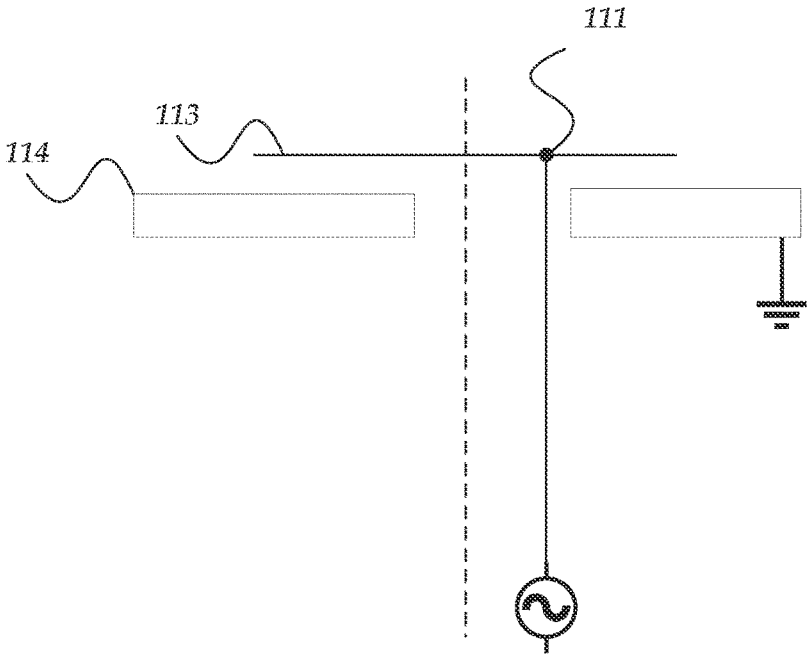
FIG. 1A - PRIOR ART
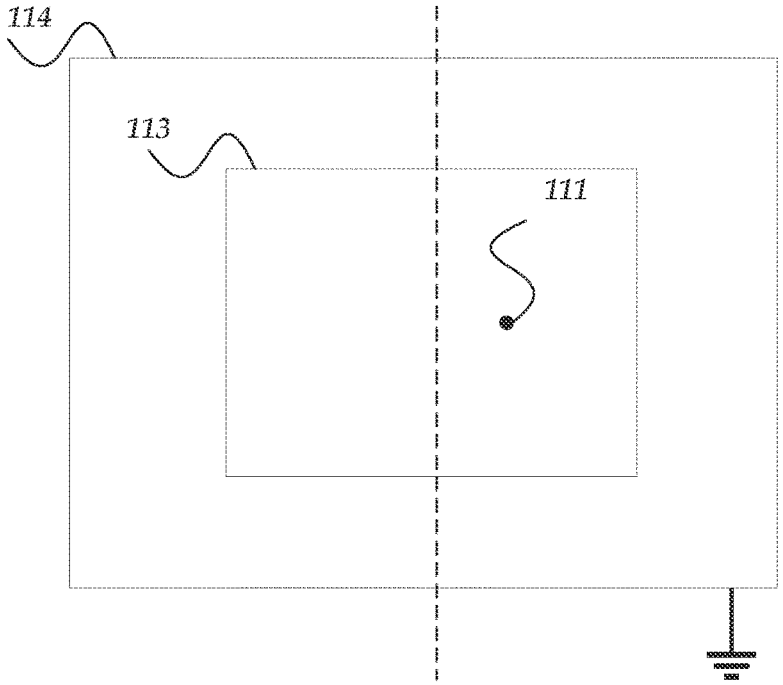
FIG. 1B – PRIOR ART

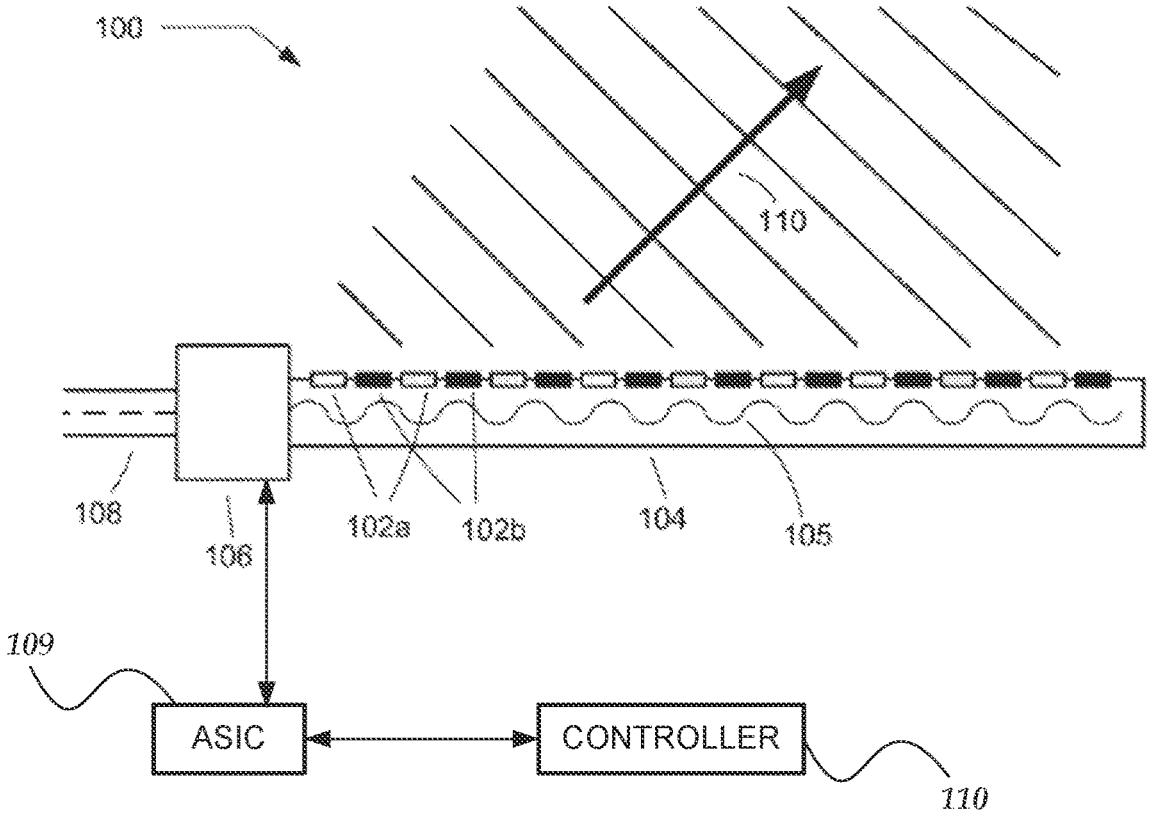
FIG. 1C – PRIOR ART
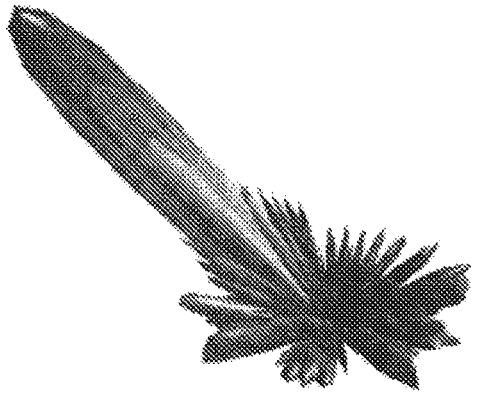
FIG. 1D – PRIOR ART

Z1 = Z2

S2 CLOSED

S2 OPEN

S2 CLOSED

SWITCHABLE PATCH ANTENNA

CROSS-REFERENCE TO RELATED APPLICATIONS

This Utility Patent Application is a Continuation of U.S. patent application Ser. No. 16/673,852 filed on Nov. 4, 2019, now U.S. Pat. No. 10,971,813 issued on Apr. 6, 2021, which is a Continuation of U.S. patent application Ser. No. 16/280,939 filed on Feb. 20, 2019, now U.S. Pat. No. 10,468,767 issued on Nov. 5, 2019, the benefit of which is claimed under 35 U.S.C. § 120, and the contents of which are each further incorporated in entirety by reference.

TECHNICAL FIELD

This antenna relates to a patch antenna, and in particular a patch antenna that is switchable to turn off radiation of sinusoidal signals suitable, but not exclusively, for telecommunication.

BACKGROUND

Patch (or microstrip) antennas typically include a flat metal sheet mounted over a larger metal ground plane. The flat metal sheet usually has a rectangular shape, and the metal layers are generally separated using a dielectric spacer. The flat metal sheet has a length and a width that can be optimized to provide a desired input impedance and frequency response. Patch antennas can be configured to provide linear or circular polarization. Patch antennas are popular because of their simple design, low profile, light weight, and low cost. An exemplary patch antenna is shown in FIGS. 1A and 1B.

Additionally, multiple patch antennas on the same printed circuit board may be employed by high gain array antennas, phased array antennas, or holographic metasurface antennas (HMA), in which a beam of radiated waveforms for a radio frequency (RF) signal or microwave frequency signal may be electronically shaped and/or steered by large arrays of antennas. An exemplary HMA antenna and a beam of radiated waveforms is shown in FIGS. 1C and 1D. Historically, the individual antennas are located closely together to shape and steer a beam of radiated waveforms for a provided sinusoidal signal. Unfortunately, signals may be mutually coupled between the antennas because of their close proximity to each other. Improved designs are constantly sought to improve performance and further reduce cost. In view of at least these considerations, the novel inventions disclosed herein were created.

BRIEF DESCRIPTION OF THE DRAWINGS

FIG. 1A illustrates an embodiment of a schematic side view of a patch antenna that is known in the prior art;

FIG. 1B shows an embodiment of a schematic top view of a patch antenna that is known in the prior art;

FIG. 1C shows an embodiment of an exemplary surface scattering antenna with multiple varactor elements arranged to propagate electromagnetic waveforms to form an exemplary instance of Holographic Metasurface Antennas (HMA);

FIG. 1D shows an embodiment of an exemplary beam of electromagnetic wave forms generated by the Holographic Metasurface Antennas (HMA) shown in FIG. 1C;

DESCRIPTION OF THE EMBODIMENTS

Figure 2A:
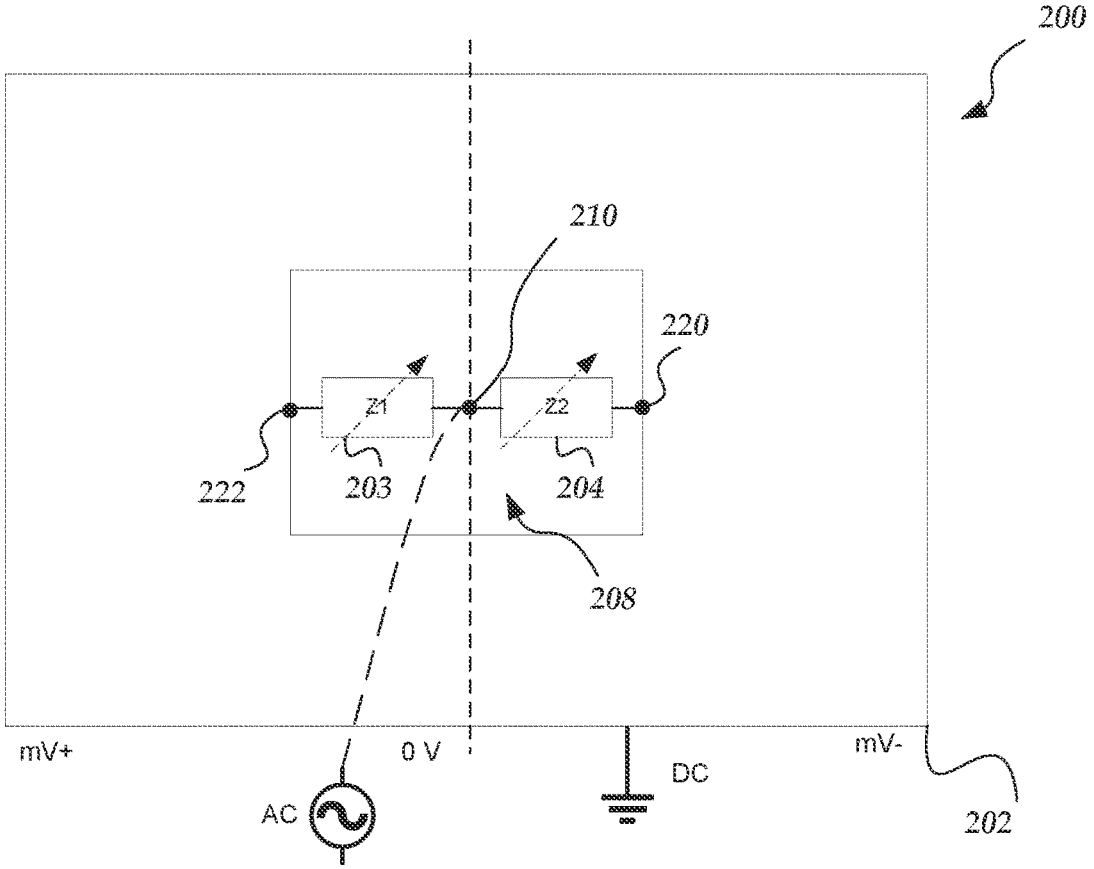
FIG. 2A illustrates a schematic top view of an exemplary switchable patch antenna that is arranged in a monopole mode of radiation, wherein two components having separate variable impedances (Z1 and Z2) are coupled to each other and a signal source at a terminal centered in a middle of an aperture.

The present invention now will be described more fully hereinafter with reference to the accompanying drawings, which form a part hereof, and which show, by way of illustration, specific embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment, an entirely software embodiment or an embodiment combining software and hardware aspects. The following detailed description is, therefore, not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, though it may. Similarly, the phrase "in another embodiment" as used herein does not necessarily refer to a different embodiment, though it may. As used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

The following briefly describes the embodiments of the invention in order to provide a basic understanding of some aspects of the invention. This brief description is not intended as an extensive overview. It is not intended to identify key or critical elements, or to delineate or otherwise narrow the scope. Its purpose is merely to present some concepts in a simplified form as a prelude to the more detailed description that is presented later.

Briefly stated, various embodiments are directed towards an antenna configured as a switchable patch antenna. An exemplary switchable patch antenna comprises a planar conductor having an aperture (hole) formed in the middle of the planar conductor. Radiation of a sinusoidal signal is controlled by comparison of separate impedance values for two components that have separate impedance values. Each of the two components have one end coupled together at the terminal positioned at a center of the aperture and their other ends separately coupled to opposing edges of the aperture. A sinusoidal signal source, e.g., an alternating current (AC) signal source, is also coupled to the terminal positioned at the aperture's center. Further, when the impedance values of both components are substantially equivalent, radiation by the antenna of the provided signal and/or mutual coupling of other signals is disabled. Also, when an impedance value of one of the two components is substantially greater than the other impedance value of the other component, the provided signal is radiated and/or mutual coupling is enabled.

In one or more embodiments, a positive waveform of the signal is radiated towards the component having an impedance value substantially less than another impedance value of the other component. In this way, a phase of the radiated signal may be shifted 180 degrees based on which of the two components provides an impedance value substantially less than the other impedance value provided by the other component.

In one or more embodiments, a first component provides a fixed impedance value and the second component provides a variable impedance value. Further, the variable impedance value of the second component may be provided by one or more of an electronic switch, mechanical switch, varactor, relay, or the like. In one or more embodiments, when a switch is conducting (closed) its variable impedance value is relatively low, e.g., one ohm, and when the switch is non-conducting (open) the variable impedance value may be infinity. Thus, when the non-conducting switch's variable impedance value is substantially greater (infinity) than the fixed impedance value of the first component, a signal is radiated by the antenna. Conversely, the signal is non-radiated when the second component's switch is conducting and it's variable impedance value is substantially equivalent to the fixed impedance value.

In one or more embodiments, a fixed impedance value may be provided for the first or second component during manufacture of the switchable patch antenna, e.g., a metal wire, metallic trace, extended segment of the planar surface, resistor, capacitor, inductor, or the like that provides a known (fixed) impedance value between the centrally located terminal and another terminal at an edge of the aperture. Further, in one or more embodiments, during manufacture of the switchable patch antenna, a low level (conducting) of a variable impedance value provided by one of the two components is selected to be substantially equivalent to a fixed impedance value or a low level (conducting) of another variable impedance value provided by the other of the two components. Additionally, a high level (non-conducting) of a variable impedance value provided by one of the two components is selected to be substantially greater than a fixed impedance value or the low level (conducting) of another variable impedance value provided by the other of the two components.

In one or more embodiments, a direct current (DC) ground is coupled to one or more portions of the planar conductor to help with impedance match, radiation patterns and be part of a bias for one or more of the two components that provide a variable impedance value. Also, in one or more embodiments, a shape of the aperture formed in the planar conductor can include rectangular, square, triangular, circular, curved, elliptical, quadrilateral, polygon, or the like.

In one or more embodiments, a length of the aperture is one half of a wavelength (lambda) of the signal. Also, in one or more embodiments, the signal comprises a radio frequency signal, a microwave frequency signal, or the like. Further, the signal may be provided by an electronic circuit, a signal generator, a waveguide, or the like coupled to the end of the segment of the planar conductor within the aperture.

Additionally, in one or more embodiments, a holographic metasurface antennas (HMA) is employed that uses a plurality of the switchable path antennas as scattering elements to radiate a shaped and steered beam based on the provided AC signal. And any signal radiated by any of the plurality of switchable patch antennas, or any other resonant structures, is not mutually coupled to those switchable patch antennas that have their switch operating in a conduction state (closed).

Also, in one or more embodiments, to further reduce mutual coupling between closely located antennas, e.g., an array of antennas in an HMA, a distance between the planar conductors of these antennas may be arranged to be no more than a length of the radiated waveform of the provided signal divided by three and no less than a length of the waveform divided by eleven.

An exemplary prior art embodiment of a schematic side view of a non-switchable patch antenna is shown in FIG. 1A. Further, an exemplary embodiment of schematic top view is shown in FIG. 1B. As shown, the patch antenna is well known in the prior art and consists of a top planar (flat) sheet 113 or "patch" of conductive material such as metal, mounted over a larger planar sheet of metal 114 that operates as a ground plane. These two planar conductors are arranged to form a resonant part of a microstrip transmission line, and the top planar conductor is arranged to have a length of approximately one-half of a length of a signal waveform that the patch antenna is intended to radiate. A signal input to the top planar sheet 113 is offset from a center of the top planar sheet. Radiation of the signal waveforms is caused in part by discontinuities at the truncated edge of the top planar conductor (patch). Also, since the radiation occurs at the truncated edges of the top patch, the patch antenna acts slightly larger than its physical dimensions. Thus, for a patch antenna to be resonant (capacitive load equal to the inductive load), a length of the top planar conductor (patch) is typically arranged to be slightly shorter than one-half of the wavelength of the radiated waveforms.

In some embodiments, when patch antennas are used at microwave frequencies, the wavelengths of the signal are short enough that the physical size of the patch antenna can be small enough to be included in portable wireless devices, such as mobile phones. Also, patch antennas may be manufactured directly on the substrate of a printed circuit board.

In one or more embodiments, an HMA may use an arrangement of controllable elements (antennas) to produce an object wave. Also, in one or more embodiments, the controllable elements may employ individual electronic circuits, such as varactors, that have two or more different states. In this way, an object wave can be modified by changing the states of the electronic circuits for one or more of the controllable elements. A control function, such as a hologram function, can be employed to define a current state of the individual controllable elements for a particular object wave. In one or more embodiments, the hologram function can be predetermined or dynamically created in real time in response to various inputs and/or conditions. In one or more embodiments, a library of predetermined hologram functions may be provided. In the one or more embodiments, any type of HMA can be used to that is capable of producing the beams described herein.

FIG. 1C illustrates one embodiment of a prior art HMA which takes the form of a surface scattering antenna 100 (i.e., an HMA) that includes multiple scattering elements 102*a*, 102*b* that are distributed along a wave-propagating structure 104 or other arrangement through which a reference wave 105 can be delivered to the scattering elements. The wave propagating structure 104 may be, for example, a microstrip, a coplanar waveguide, a parallel plate waveguide, a dielectric rod or slab, a closed or tubular waveguide, a substrate-integrated waveguide, or any other structure capable of supporting the propagation of a reference wave 105 along or within the structure. A reference wave 105 is input to the wave-propagating structure 104. The scattering elements 102*a*, 102*b* may include scattering elements that are embedded within, positioned on a surface of, or positioned within an evanescent proximity of, the wave-propagation structure 104. Examples of such scattering elements include, but are not limited to, those disclosed in U.S. Pat. Nos. 9,385,435; 9,450,310; 9,711,852; 9,806,414; 9,806,415; 9,806,416; and 9,812,779 and U.S. Patent Applications Publication Nos. 2017/0127295; 2017/0155193; and 2017/0187123, all of which are incorporated herein by reference in their entirety. Also, any other suitable types or arrangement of scattering elements can be used.

The surface scattering antenna may also include at least one feed connector 106 that is configured to couple the wave-propagation structure 104 to a feed structure 108 which is coupled to a reference wave source (not shown). The feed structure 108 may be a transmission line, a waveguide, or any other structure capable of providing an electromagnetic signal that may be launched, via the feed connector 106, into the wave-propagating structure 104. The feed connector 106 may be, for example, a coaxial-to-microstrip connector (e.g. an SMA-to-PCB adapter), a coaxial-to-waveguide connector, a mode-matched transition section, etc.

The scattering elements 102*a*, 102*b* are adjustable scattering antennas having electromagnetic properties that are adjustable in response to one or more external inputs. Adjustable scattering elements can include elements that are adjustable in response to voltage inputs (e.g. bias voltages for active elements (such as varactors, transistors, diodes) or for elements that incorporate tunable dielectric materials (such as ferroelectrics or liquid crystals)), current inputs (e.g. direct injection of charge carriers into active elements), optical inputs (e.g. illumination of a photoactive material), field inputs (e.g. magnetic fields for elements that include nonlinear magnetic materials), mechanical inputs (e.g. MEMS, actuators, hydraulics), or the like. In the schematic example of FIG. 1C, scattering elements that have been adjusted to a first state having first electromagnetic properties are depicted as the first elements 102*a*, while scattering elements that have been adjusted to a second state having second electromagnetic properties are depicted as the second elements 102*b*. The depiction of scattering elements having first and second states corresponding to first and second electromagnetic properties is not intended to be limiting: embodiments may provide scattering elements that are discretely adjustable to select from a discrete plurality of states corresponding to a discrete plurality of different electromagnetic properties, or continuously adjustable to select from a continuum of states corresponding to a continuum of different electromagnetic properties.

In the example of FIG. 1C, the scattering elements 102*a*, 102*b* have first and second couplings to the reference wave 105 that are functions of the first and second electromagnetic properties, respectively. For example, the first and second couplings may be first and second polarizabilities of the scattering elements at the frequency or frequency band of the reference wave. On account of the first and second couplings, the first and second scattering elements 102*a*, 102*b* are responsive to the reference wave 105 to produce a plurality of scattered electromagnetic waves having amplitudes that are functions of (e.g. are proportional to) the respective first and second couplings. A superposition of the scattered electromagnetic waves comprises an electromagnetic wave that is depicted, in this example, as an object wave 110 that radiates from the surface scattering antenna 100.

FIG. 1C illustrates a one-dimensional array of scattering elements 102*a*, 102*b*. It will be understood that two- or three-dimensional arrays can also be used. In addition, these arrays can have different shapes. Moreover, the array illustrated in FIG. 1C is a regular array of scattering elements 102*a*, 102*b* with equidistant spacing between adjacent scattering elements, but it will be understood that other arrays may be irregular or may have different or variable spacing between adjacent scattering elements. Also, Application Specific Integrated Circuit (ASIC) 109 is employed to control the operation of the row of scattering elements 102*a* and 102*b*. Further, controller 112 may be employed to control the operation of one or more ASICs that control one or more rows in the array.

The array of scattering elements 102*a*, 102*b* can be used to produce a far-field beam pattern that at least approximates a desired beam pattern by applying a modulation pattern (e.g., a hologram function, H) to the scattering elements receiving the reference wave ($\psi_{ref}$) from a reference wave source. Although the modulation pattern or hologram function is illustrated as sinusoidal, it will be recognized non-sinusoidal functions (including non-repeating or irregular functions) may also be used.

In at least some embodiments, the hologram function H (i.e., the modulation function) is equal to the complex conjugate of the reference wave and the object wave, i.e., $\psi_{ref}^{*}\psi_{obj}$. In at least some embodiments, the surface scattering antenna may be adjusted to provide, for example, a selected beam direction (e.g. beam steering), a selected beam width or shape (e.g. a fan or pencil beam having a broad or narrow beam width), a selected arrangement of nulls (e.g. null steering), a selected arrangement of multiple beams, a selected polarization state (e.g. linear, circular, or elliptical polarization), a selected overall phase, or any combination thereof. Alternatively, or additionally, embodiments of the surface scattering antenna may be adjusted to provide a selected near field radiation profile, e.g. to provide near-field focusing or near-field nulls.

Also, although not shown, the invention is not limited to a varactor as a control element that enables a scattering element to emit a signal. Rather, many different types of control elements may be employed in this way. For example, one or more other embodiments may instead employ Field Effect Transistors (FETs), Microelectromechanical Systems (MEMS), Bipolar Junction Transistors (BSTs), or the like to enable scattering elements to turn on and turn off emitting the signal. Additionally, FIG. 1D shows an embodiment of an exemplary beam of electromagnetic wave forms generated by the HMA shown in FIG. 1C.

A generalized embodiment of the invention is shown in FIG. 2A. Terminal 210 operates as an input for a sinusoidal signal provided to patch antenna 200. Also, the patch antenna operates as an impedance comparator between an impedance value Z1 for component 203 and an impedance value Z2 for component 204. These components are coupled between terminals (222 and 220) at opposing edges of aperture 208 and center terminal 210. In one or more embodiments, at least one of the impedance values is variable to a high level and a low level while the other impedance value is fixed at a low level. In one or more embodiments, one of impedance values Z1 or Z2 is a fixed impedance value and the other is a variable impedance value that can be switched from a low level substantially equivalent to the fixed impedance value and a high level that is substantially greater than the fixed impedance value. Also, in one or more embodiments, both the impedance values Z1 and Z2 are variable impedance values.

Figure 2B:
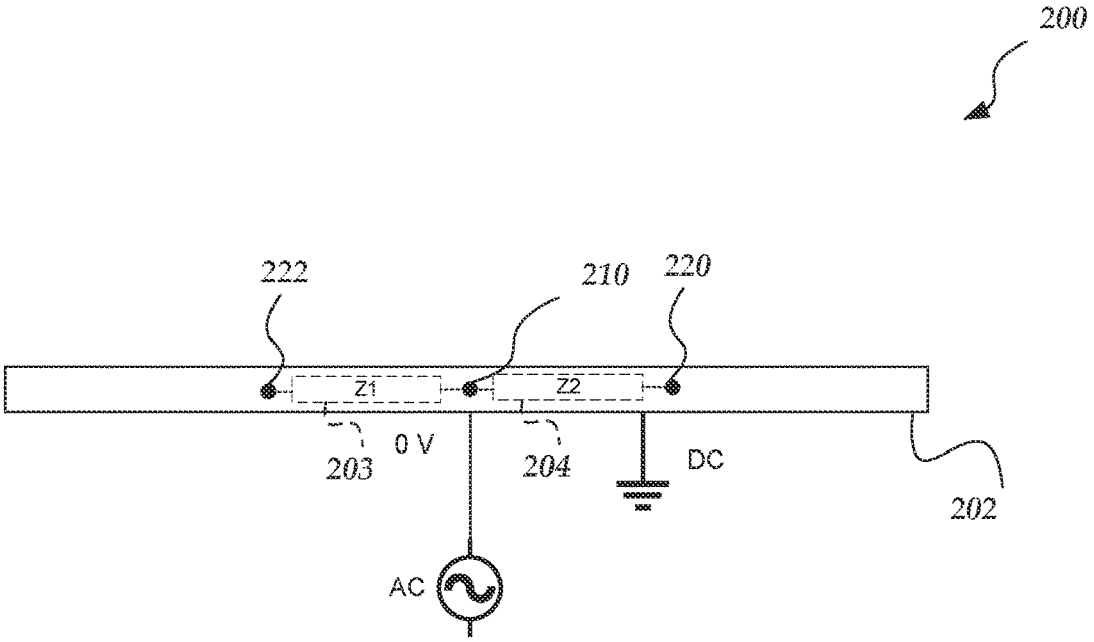
FIG. 2B shows a schematic side view of an exemplary switchable patch antenna, wherein the separate variable impedance values (Z1 and Z2) of a first component and a second component are substantially equivalent to each other and the antenna is not radiating a signal provided by a signal source.

As shown in FIG. 2B, when the impedance value Z1 is approximately equal to the impedance value Z2, the patch antenna does not radiate the sinusoidal signal and/or mutually couple with other signals. Although not shown here, the same effect occurs when a switch representing first component 203 is conducting (a short) which has substantially the same impedance value as the short by another switch representing the second component 204 on the other side of the patch antenna.

Figure 2C:
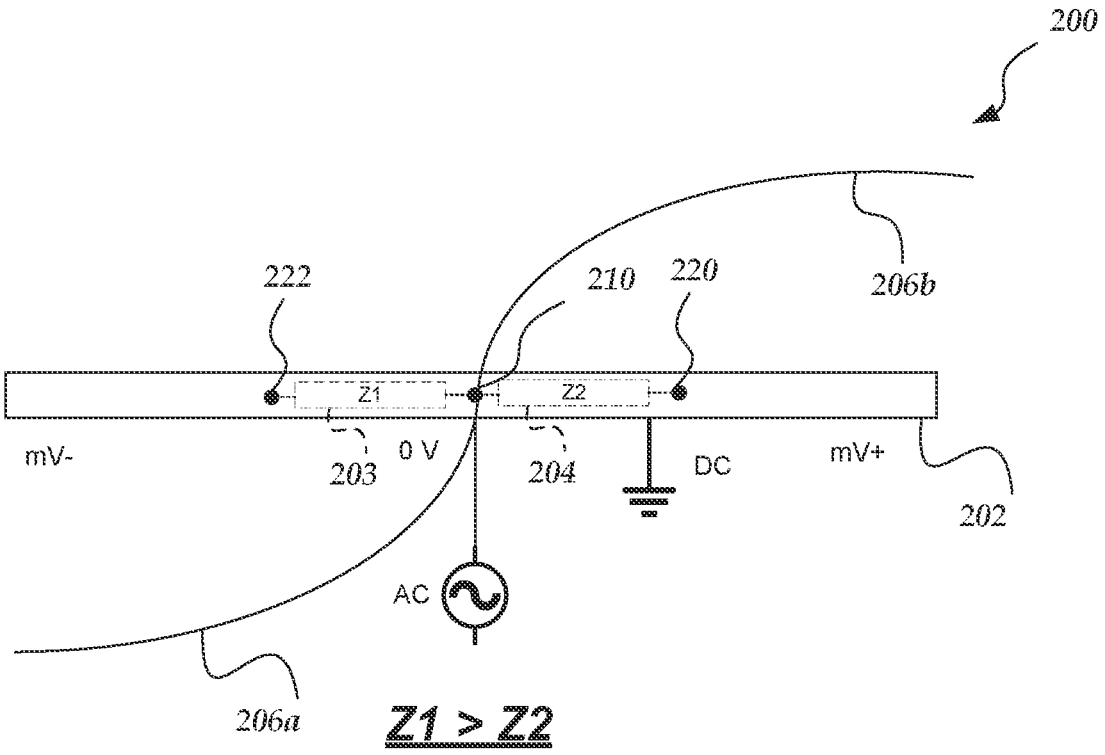
FIG. 2C illustrates a schematic side view of an exemplary switchable patch antenna, wherein a variable impedance value Z1 of the first component is substantially greater than a variable impedance value Z2 of the second component so that a signal is radiated by the antenna.
Figure 2D:
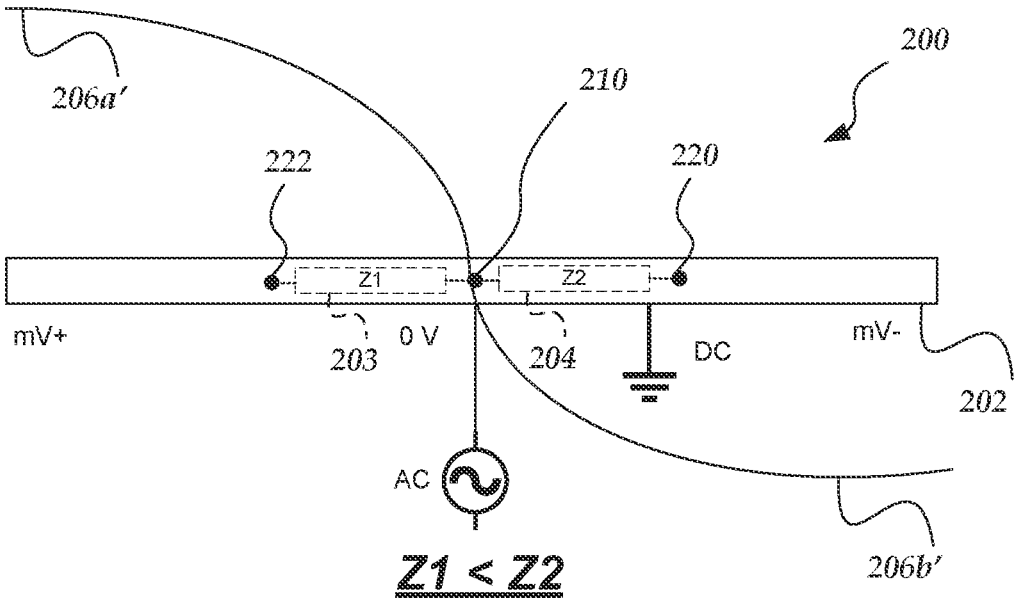
FIG. 2D shows a schematic side view of an exemplary switchable patch antenna, wherein a variable impedance value Z2 of the first component is substantially greater than a variable impedance value Z1 of the second component so that a signal having a 180 degree opposite phase to be radiated by the antenna.

As shown in FIG. 2D, when the impedance value Z1 is less than the impedance value Z2, then the sinusoidal signal travels towards the impedance value Z1, and there is radiation of the sinusoidal signal with a particular phase angle. Alternatively, as shown in FIG. 2C, when the impedance value Z1 is greater than the impedance value Z2, then the sinusoidal signal travels towards the impedance value Z2, and there is radiation of the sinusoidal signal at a phase angle that is 180 degrees offset from the radiation of the sinusoidal signal shown in FIG. 2D. This 180 degree phase angle offset may be used to optimize the radiation pattern of a phased array antenna or HMA antenna.

Figure 2E:
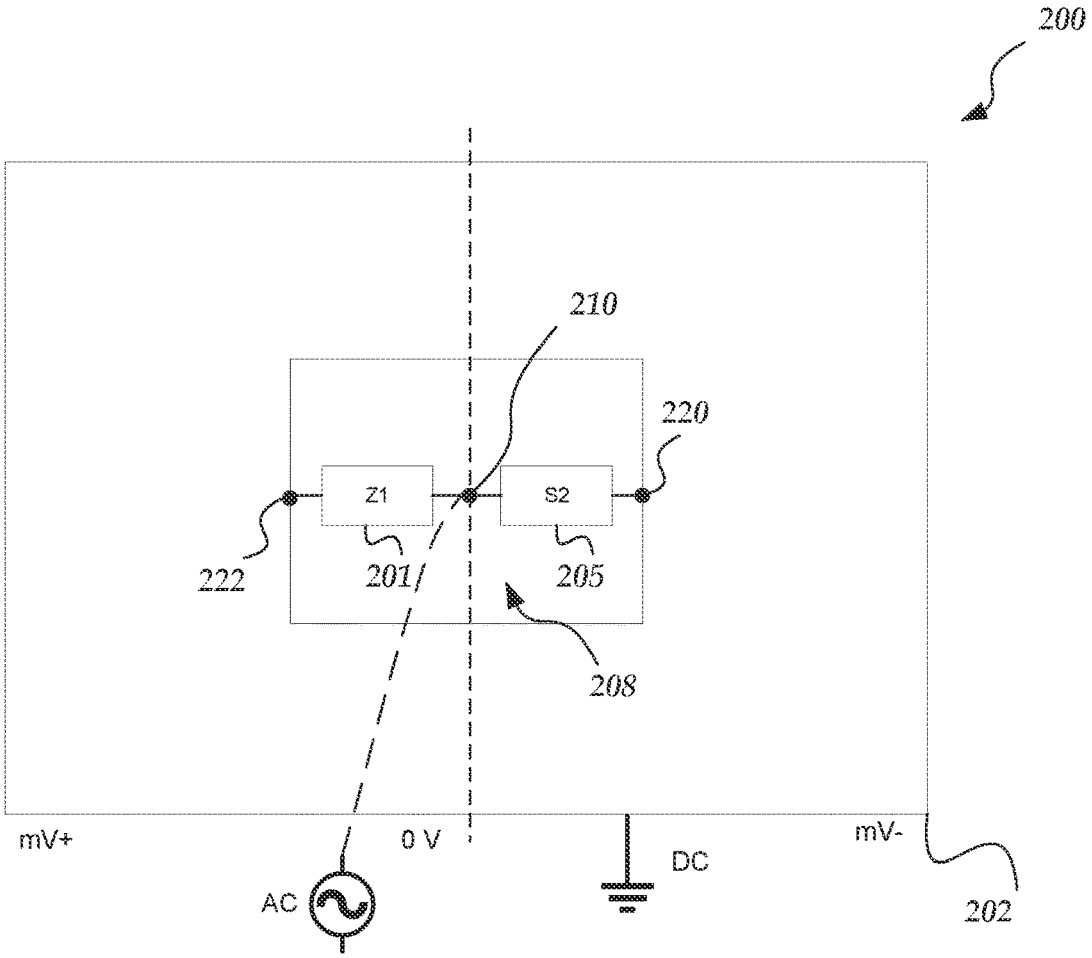
FIG. 2E illustrates a top view of an exemplary switchable patch antenna that is arranged in a monopole mode of operation, wherein a first component provides a fixed impedance value Z1 and a second component includes a switch S2 that provides a variable impedance value that is either substantially equivalent to fixed impedance value Z1 when the switch is conducting (closed) or the variable impedance value is substantially greater (infinity) than fixed impedance value Z1 when the switch is non-conducting (open)

FIG. 2E illustrates a top view of an exemplary switchable patch antenna that is arranged in a monopole mode of operation. A first component 201 is coupled to edge terminal 222 and center terminal 210 and provides a fixed impedance value Z1. Second component 205 is coupled between opposing edge terminal 220 and center terminal 210 and includes a switch S2. Further, switch S2 provides a variable impedance value that is either substantially equivalent to fixed impedance value Z1 when the switch is conducting (closed) or the variable impedance value is substantially greater (infinity) than fixed impedance value Z1 when the switch is non-conducting (open). An alternating current (AC) signal source provides a sinusoidal signal at center terminal 210. Aperture 208 is formed in a substantially rectangular shape in a middle of planar surface 202, which is manufactured from a conductive material, e.g., metal. Also, a Direct Current (DC) source ground is coupled to planar surface 202.

In one or more embodiments, switch S2 may include one or more of an electronic switch, a varactor, a relay, a fuse, a mechanical switch, and the like. Further, because the radiating standing wave on the patch antenna has a virtual ground along the center axis of planar surface 202, the sinusoidal signal presented at center terminal 210 tries to connect to the patch antenna's offset from the center terminal 210 to edge terminal 222 when the variable impedance of switch S2 is substantially greater than fixed impedance value Z1, as discussed in regard to FIGS. 2A-2D.

Figure 2F:
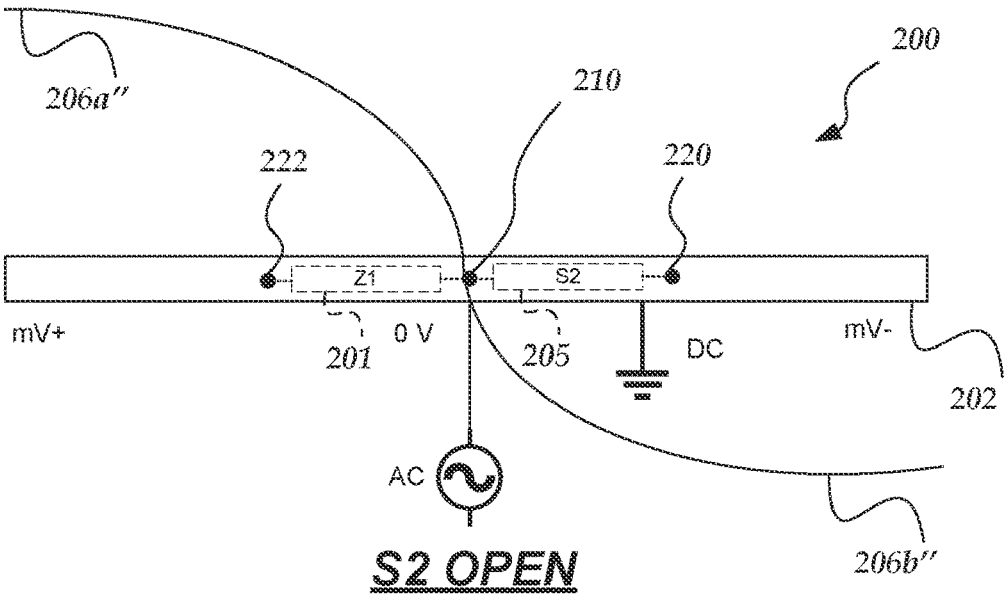
FIG. 2F shows a schematic side view of an exemplary switchable patch antenna, wherein a variable impedance value of the of the second component is substantially greater than a fixed impedance value Z1 of the first component when switch S2 is non-conducting (open) and a signal is radiated by the antenna.

FIG. 2F shows a schematic side view of an exemplary switchable patch antenna. In this embodiment, a variable impedance value of switch S2 is substantially greater than a fixed impedance value Z1 of first component 201 because switch S2 is non-conducting (open). This large disparity in the impedance values of components 201 and 205 causes radiation of the sinusoidal signal by switchable patch antenna 200.

Figure 2G:
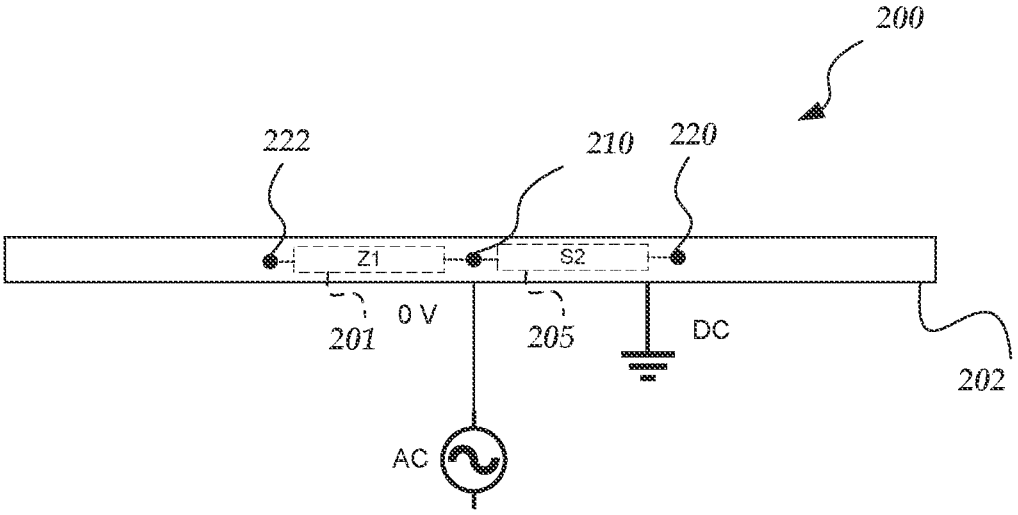
FIG. 2G illustrates a schematic side view of an exemplary switchable patch antenna, wherein switch S2 is conducting (closed) so that the variable impedance value of the second component is substantially equal to a fixed impedance value Z1 of the first component and no signal is radiated by the antenna.

FIG. 2G illustrates a schematic side view of an exemplary switchable patch antenna. In this embodiment, a variable impedance value of switch S2 for second component 205 is substantially equal to a fixed impedance value Z1 of first component 201 and no signal is radiated or mutually coupled by the antenna.

Figure 2H:
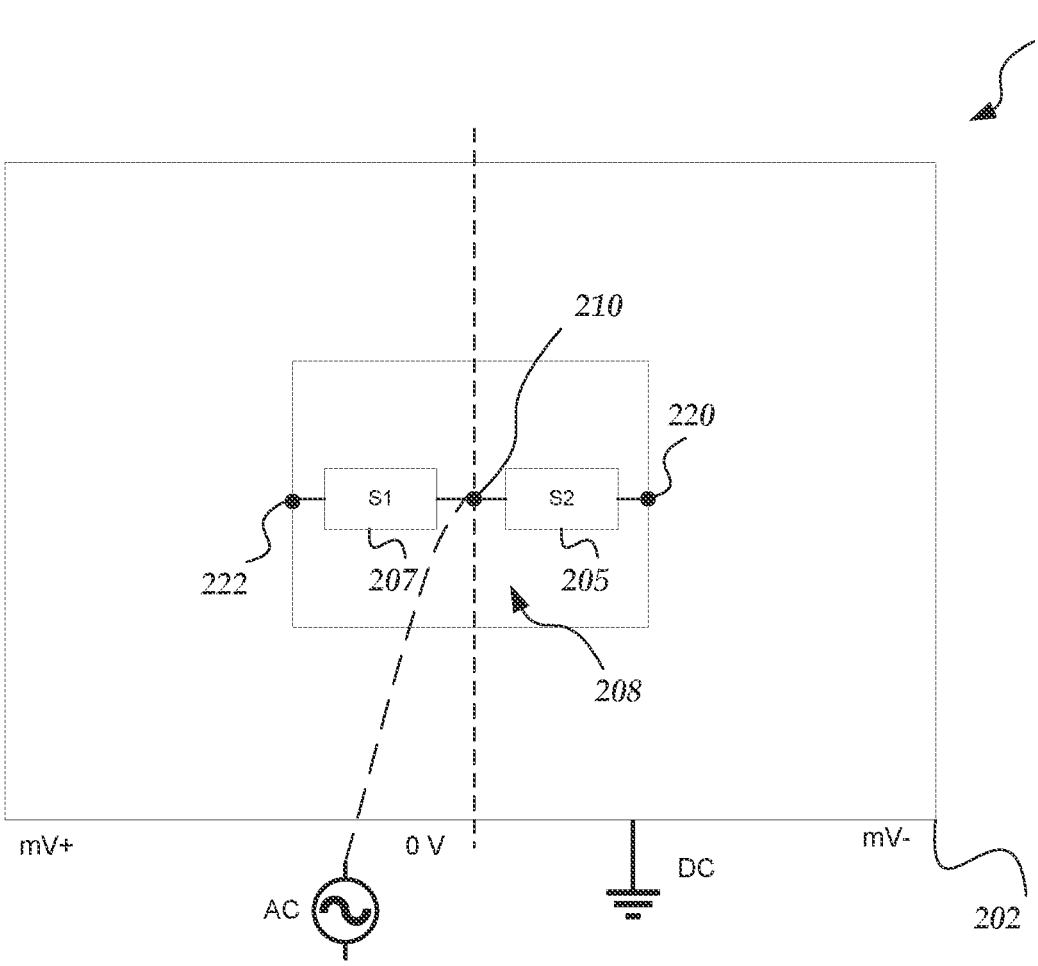
FIG. 2H shows a top view of an exemplary switchable patch antenna that is arranged in a monopole mode of operation, wherein a first component has a switch S1 with a variable impedance value and a second component includes switch S2 that also provides a variable impedance value, wherein the variable impedance values of switch S1 and switch S2 are substantially equivalent when they are both conducting, and wherein the variable impedance value of either switch that is non-conducting is substantially greater than the variable impedance value of the other switch that is conducting.

FIG. 2H shows a top view of an exemplary switchable patch antenna that is arranged in a monopole mode of operation, wherein a first component has a switch S1 with a variable impedance value and a second component includes switch S2 that also provides a variable impedance value, wherein the variable impedance values of switch S1 and switch S2 are substantially equivalent when they are both conducting, and wherein the variable impedance value of either switch that is non-conducting is substantially greater than the variable impedance value of the other switch that is conducting. In this way, a phase angle of the sinusoidal signal radiated by switchable patch antenna may be changed 180 degrees depending upon which of switch S1 or switch S2 are conducting or non-conducting. As shown in FIGS. 2C and 2D, and the corresponding text.

In one or more embodiments, switchable patch antenna 200 operates by being resonant at a desired center frequency with a half wavelength sine wave voltage distribution across the patch as shown in FIG. 2C (206*a* and 206*b*), FIG. 2D (206*a*' and 206*b*'), and FIG. 2F (206*a*") and 206*b*"). Further, because the sinusoidal signal's voltage passes thru zero Volts at a center terminal of the aperture in the planar surface of the switchable patch antenna, there is no sinusoidal current flow at the center terminal of the switchable patch antenna. Thus, the switchable patch antenna may operate with both contiguous and non-contiguous metallization across the center of the planar surface. Further, since the sinusoidal signal's voltage is zero Volts at the center terminal, the switchable patch antenna can also be mechanically shorted to ground as mentioned above without affecting the operation of the antenna.

So, in one or more embodiments, when the planar conductor is one contiguous region, the switchable patch antenna operates in a monopole mode. However, in one or more other embodiments, when the planar conductor includes two separate regions separated by a narrow gap, the switchable patch antenna radiates a provided sinusoidal signal in a dipole mode of operation. To provide the dipole mode of operation, the planar conductor of the switchable patch antenna is arranged differently into two separate regions that are electrically (and physically) connected to each other through the first component and second components. Also, a width of the non-conductive gap is minimized to optimize a dipole mode of radiation for the sinusoidal signal. The two components bridge the gap and electrically (and physically) connect the two regions of the planar surface to each other. An exemplary embodiment of the switchable patch antenna operating in a dipole mode is shown in FIGS. 3A and 3D.

Figure 3A:
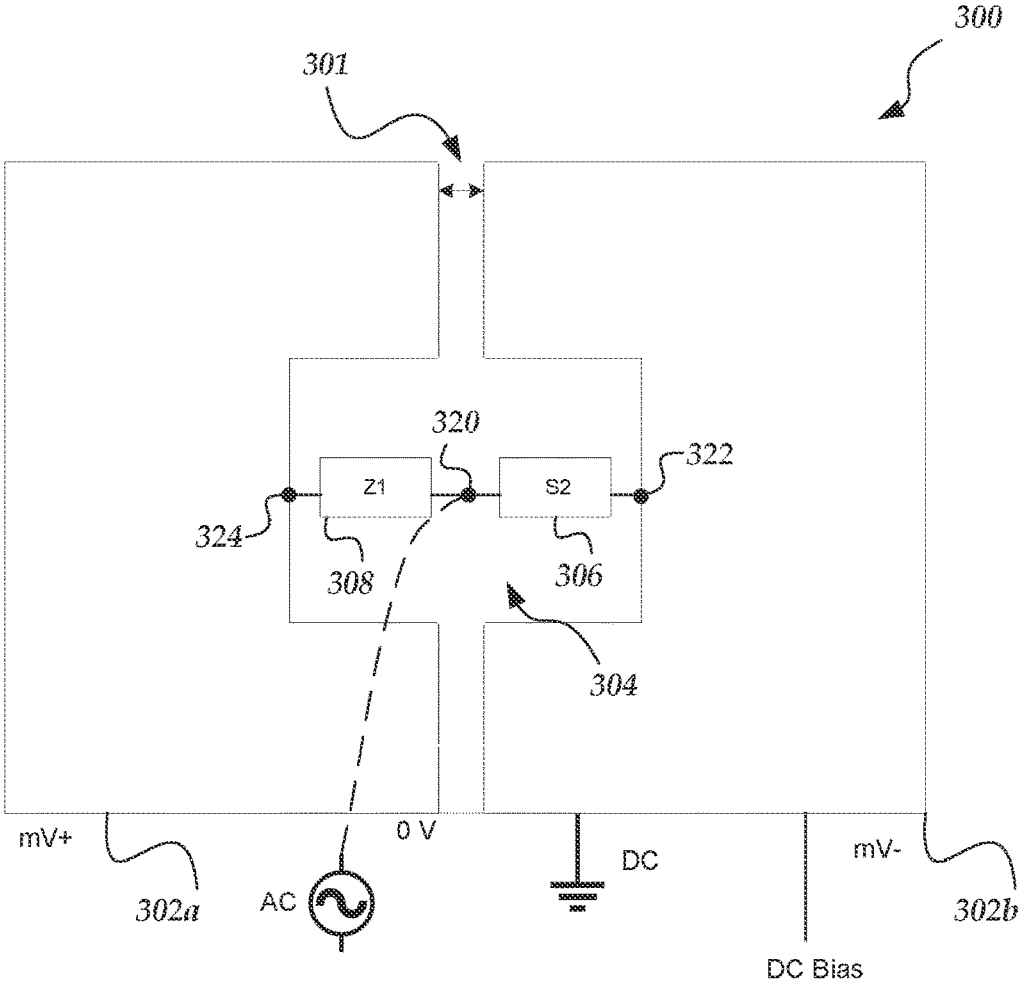
FIG. 3A illustrates a schematic top view of an exemplary switchable patch antenna that is arranged with a gap to provide a dipole mode of radiation, wherein a first component provides a fixed impedance value Z1 and a second component includes a switch S2 that provides a variable impedance value that is either substantially equivalent to fixed impedance value Z1 when switch S2 is conducting (closed) or the variable impedance value is substantially greater (infinity) than the fixed impedance value Z1 when the switch is non-conducting (open)

FIG. 3A illustrates a schematic top view of an exemplary switchable patch antenna that is arranged with gap 301 between regions 302*a* and 302*b* to provide a dipole mode of radiation. First component 308 provides a fixed impedance value Z1. Also, first component 308 is coupled between terminal 320 positioned in the center of a planar conductor that is formed by region 302*a* and region 302*b* and further coupled to terminal 324 on an edge of a region 302*a* that opens to aperture 304. Second component 306 includes a switch S2 that provides a variable impedance value that is either substantially equivalent to fixed impedance value Z1 when switch S2 is conducting (closed) or the variable impedance value is substantially greater (infinity) than the fixed impedance value Z1 when the switch is non-conducting (open). Further, second component 306 is coupled between center terminal 320 and terminal 322 on an edge of a region 302*b* that opens to aperture 304. Also, AC signal source is coupled to center terminal 320 and a DC bias circuit is coupled to region 302*b*. The generalized operation of switchable patch antenna 300 in the dipole mode is substantially similar to the switchable patch antenna 200 in the monopole mode as shown in FIG. 2E. Additionally, in one or more embodiments, a width of non-conductive gap 301 is minimized to optimize a dipole mode of radiation for the signal. Also, a DC ground is coupled to region 302*b*.

Figure 3B:
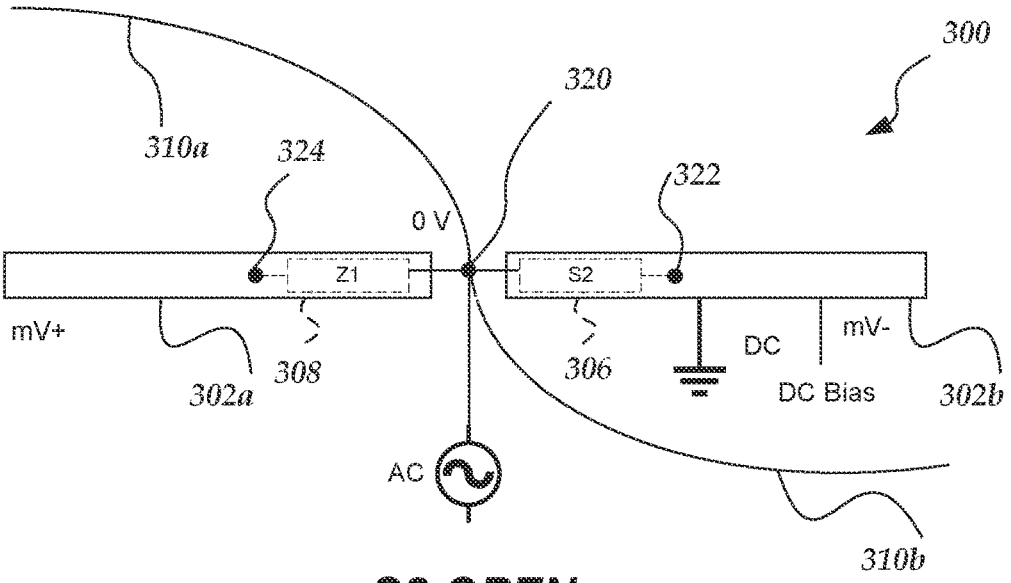
FIG. 3B shows a schematic side view of an exemplary switchable patch antenna that is arranged in a dipole mode of radiation, wherein a variable impedance value of the of the second component is substantially greater (infinity) than a fixed impedance value Z1 of the first component when switch S2 is non-conducting (open) so that a signal is radiated by the antenna.

FIG. 3B illustrates an exemplary schematic side view of switchable patch antenna 300 operating in a dipole mode when switch S2, of second component 306, is non-conducting (open). As shown, a signal is provided by a signal source to center terminal 320. The signal's peak positive waveform 310*a* and peak negative waveform 310*b* are shown at parallel and opposing edges of first region 302*a* and second region 302*b*. The signal's waveform oscillates between the opposing edges based on a particular frequency, such as microwave or radio frequencies. Also, a DC ground is coupled to region 302*b*.

Figure 3C:
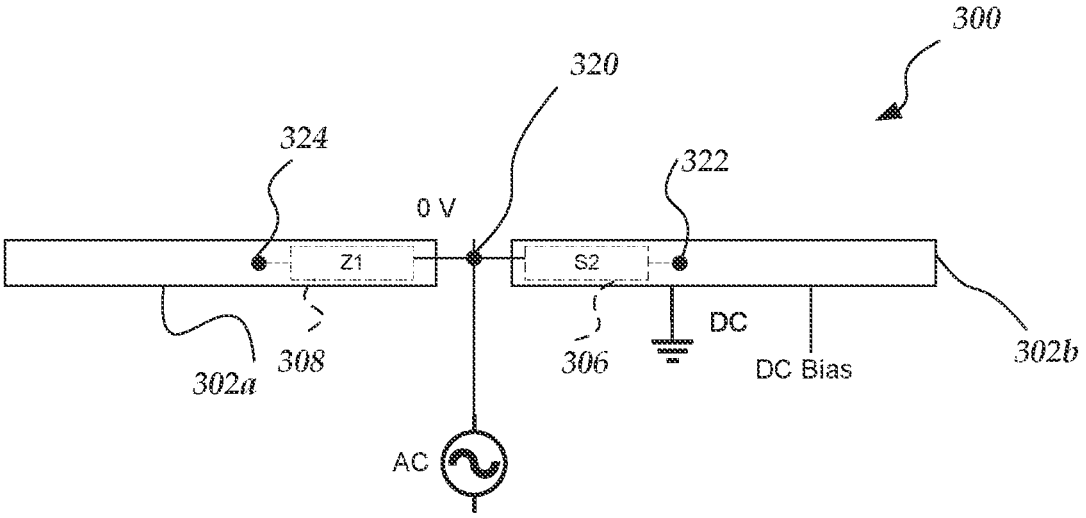
FIG. 3C illustrates a schematic side view of an exemplary switchable patch antenna that is arranged in a dipole mode of radiation, wherein the switch S2 is conducting (closed) and the variable impedance value of the second component is substantially equal to a fixed impedance value Z1 of the first component so that no signal is radiated by the antenna.
Figure 3D:
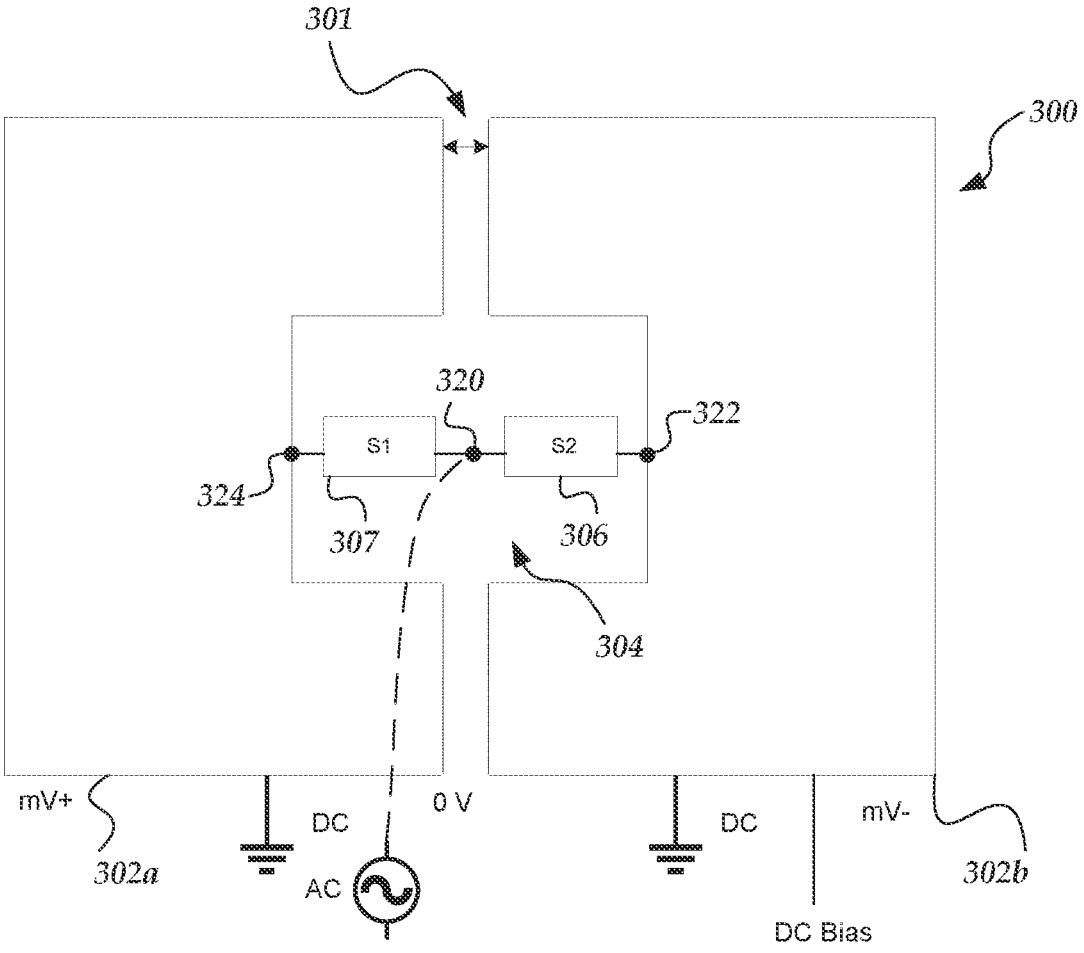
FIG. 3D shows a schematic top view of an exemplary switchable patch antenna that is arranged with a gap in a dipole mode of radiation, wherein a first component includes a switch S1 that provides a variable impedance value and a second component includes a switch S2 that provides a variable impedance value, wherein the variable impedance values of switch S1 and switch S2 are substantially equivalent when they are both conducting (closed), and wherein the variable impedance value of either switch that is non-conducting (open) is substantially greater than the variable impedance value of the other switch that is conducting (closed)

FIG. 3C illustrates a schematic side view of an exemplary switchable patch antenna 300 that is arranged in a dipole mode of radiation, when switch S2, of second component 306, is conducting (closed) and the variable impedance value of the second component is substantially equal to a fixed impedance value Z1 of first component 308. Also, a DC ground is coupled to region 302*b*. As shown, conduction of switch S2 effectively stops radiation of the provided signal or any other mutually coupled signals provided by other antennas or resonant structures.

Figure 4:
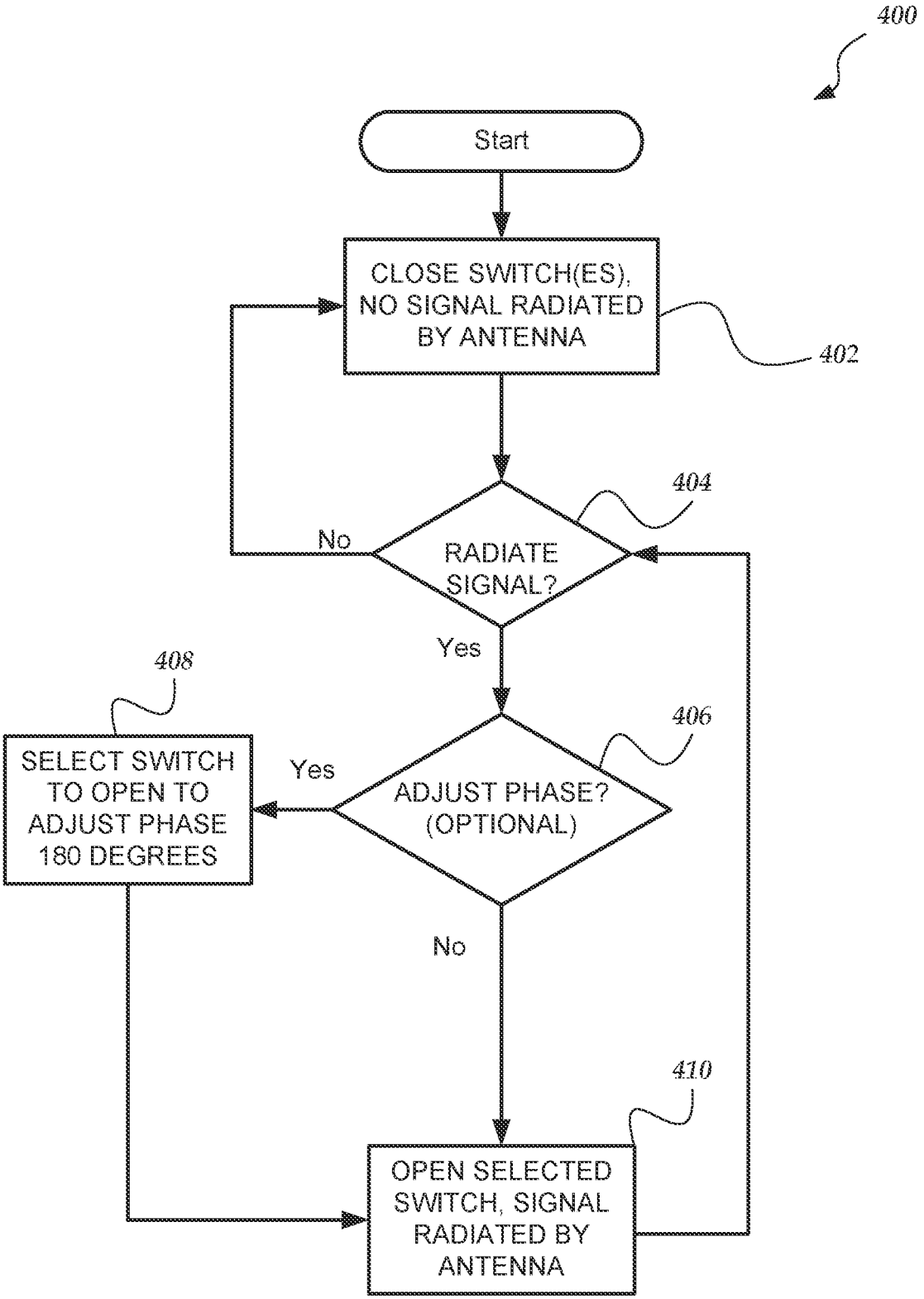
FIG. 4 illustrates a flow chart showing the operation of a switchable patch antenna.

FIG. 3D shows a schematic top view of an exemplary switchable patch antenna that is arranged with a gap in a dipole mode of radiation. First component 307 includes switch S1 that provides a variable impedance value and second component 308 includes switch S2 that provides another variable impedance value. The variable impedance values of switch S1 and switch S2 are substantially equivalent when they are both conducting (closed). Also, the variable impedance value of either switch (S1 or S2) that is non-conducting (open) is substantially greater than the variable impedance value of the other switch (S1 or S2) that is conducting (closed). In this way, a phase angle of the sinusoidal signal radiated by switchable patch antenna 300 may be changed 180 degrees depending upon which of switch S1 or switch S2 are conducting or non-conducting. As shown in FIGS. 2C and 2D, and the corresponding text. Also, a DC ground is coupled to both region 302*a* and region 302*b*. FIG. 4 shows a flow chart for method 400 for operating a switchable patch antenna. Moving from a start block, the process advances to block 402 where a switched component of the antenna is placed in a conductive (closed state) to provide a variable impedance value that is substantially equivalent to a fixed impedance value or a variable impedance value of another component. So long as the switch remains in the conductive state, the antenna will not radiate any provided signal or mutually couple another signal. At decision block 404, a determination is made as to whether to employ the antenna to radiate a signal's waveform. If no, the process loops back to block 402. However, if the determination is yes, the process optionally moves to decision block 406 where a determination is made as to wherein a phase angle of the provided signal should be shifted 180 degrees. If true, the process moves to block 410, where a switched component is selected to provide the phase shift. Next, the process moves to block 410. Also, if the optional determination at decision block 406 was false, the process would have moved directly to block 410, where a selected switched component is placed in a non-conductive state (open) to provide a variable impedance that is substantially greater than a fixed impedance value or a variable impedance value of another component. The signal is radiated by the antenna and the process loops back to decision block 404 and performs substantially the same actions.

Figure 5:
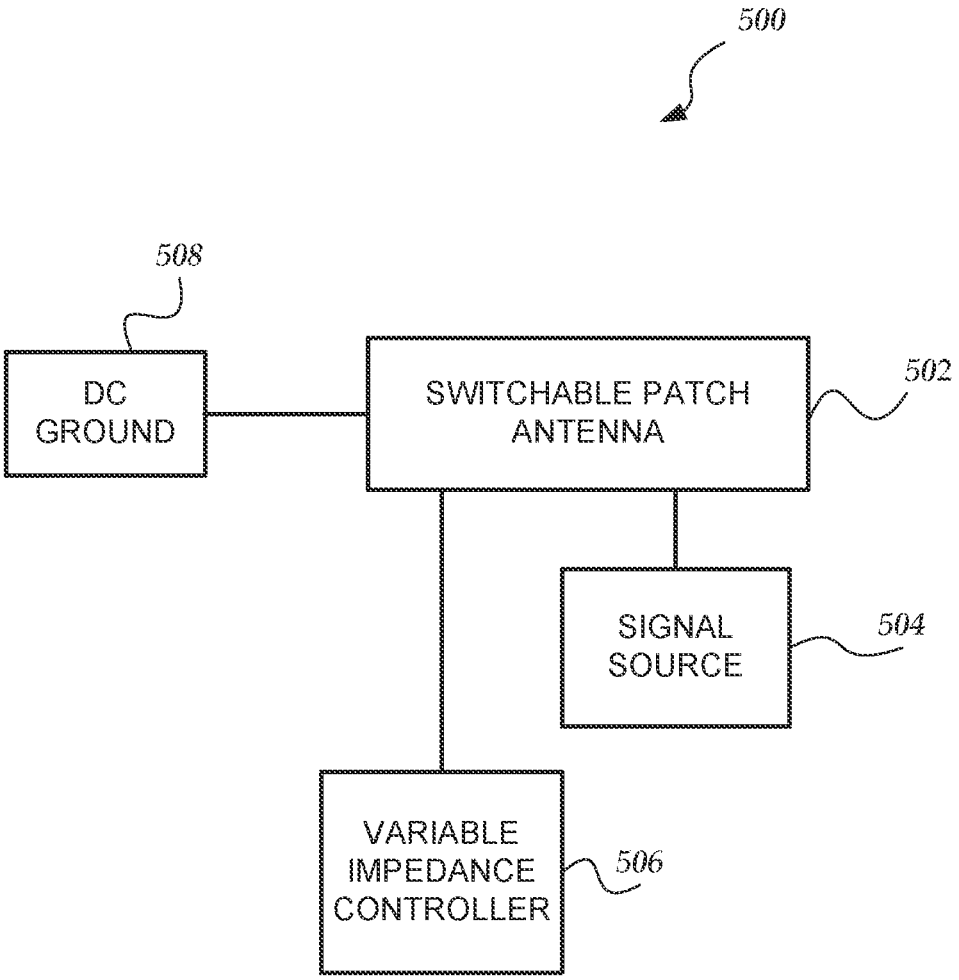
FIG. 5 shows a schematic of an apparatus for controlling the radiation of a signal by a switchable patch antenna in accordance with the one or more embodiments of the invention.

FIG. 5 shows a schematic illustration of an exemplary apparatus 500 that is employed to operate switchable patch antenna 502. Variable impedance controller 506 is employed to control a conductive and non-conductive state of a switched component included with switchable patch antenna 502 (not shown) that disables or enables radiation of a provided signal by the antenna. The signal is provided by signal source 504. Also, DC ground 508 is coupled to switchable patch antenna 502.

It will be understood that each block of the flowchart illustrations, and combinations of blocks in the flowchart illustrations, (or actions explained above with regard to one or more systems or combinations of systems) can be implemented by computer program instructions. These program instructions may be provided to a processor to produce a machine, such that the instructions, which execute on the processor, create means for implementing the actions specified in the flowchart block or blocks. The computer program instructions may be executed by a processor to cause a series of operational steps to be performed by the processor to produce a computer-implemented process such that the instructions, which execute on the processor to provide steps for implementing the actions specified in the flowchart block or blocks. The computer program instructions may also cause at least some of the operational steps shown in the blocks of the flowcharts to be performed in parallel. Moreover, some of the steps may also be performed across more than one processor, such as might arise in a multi-processor computer system. In addition, one or more blocks or combinations of blocks in the flowchart illustration may also be performed concurrently with other blocks or combinations of blocks, or even in a different sequence than illustrated without departing from the scope or spirit of the invention.

Additionally, in one or more steps or blocks, may be implemented using embedded logic hardware, such as, an Application Specific Integrated Circuit (ASIC), Field Programmable Gate Array (FPGA), Programmable Array Logic (PAL), or the like, or combination thereof, instead of a computer program. The embedded logic hardware may directly execute embedded logic to perform actions some or all of the actions in the one or more steps or blocks. Also, in one or more embodiments (not shown in the figures), some or all of the actions of one or more of the steps or blocks may be performed by a hardware microcontroller instead of a CPU. In one or more embodiment, the microcontroller may directly execute its own embedded logic to perform actions and access its own internal memory and its own external Input and Output Interfaces (e.g., hardware pins and/or wireless transceivers) to perform actions, such as System On a Chip (SOC), or the like.

The above specification, examples, and data provide a complete description of the manufacture and use of the invention. Since many embodiments of the invention can be made without departing from the spirit and scope of the invention, the invention resides in the claims hereinafter appended.

What is claimed as new and desired to be protected by Letters Patent of the United States is:

1. An apparatus, comprising:

an antenna including:

a planar conductor having an aperture formed in a portion of the planar conductor;

a variable component that is coupled between a middle of the aperture and a side of the aperture, wherein the variable component provides a variable impedance value;

a fixed component that is coupled between the middle of the aperture and an opposing side of the aperture, wherein the fixed component provides a fixed impedance value; and wherein in response to changing the variable impedance value to be non-equal to the fixed impedance value, a signal provided at the middle of the aperture is radiated by the antenna.

2. The apparatus of claim 1, when the signal is radiated by the antenna, further comprising providing a 180 degree phase shift for the radiated signal based on which of the variable impedance value or the fixed impedance value is greater than each other.

3. The apparatus of claim 1, further comprising:

a plurality of antennas, and wherein a distance between each planar conductor of each antenna is configured between one third and one eleventh of a wavelength of the signal radiated by the plurality of antennas, wherein the distance is provided to reduce mutual coupling between the plurality of antennas.

4. The apparatus of claim 1, further comprising:

a plurality of antennas, wherein the plurality of antennas are patch antennas that are arranged on a circuit board for a wireless communication device, and wherein a length of each patch antenna is less than half of a length of a wavelength of the signal provided by the signal source.

5. The apparatus of claim 1, further comprising:

a controller that performs actions, comprising:

varying the variable impedance value to match the fixed impedance value; and varying the variable impedance value to non-match the fixed impedance value.

6. The apparatus of claim 1, wherein the variable impedance value is provided by one or more of a mechanical switch, an electronic switch, a varactor, or another variable impedance device.

7. The apparatus of claim 1, wherein the signal source is arranged to further comprise one or more of a signal generator, a waveguide, or an electronic circuit, and wherein the signal is provided at a frequency that is one of a radio signal frequency or a microwave signal frequency.

8. The apparatus of claim 1, further comprising:

a direct current (DC) ground that is coupled to the planar conductor, wherein the DC ground is arranged to provide a DC bias to improve one or more of impedance matching and radiation patterns for the antenna.

9. The apparatus of claim 1, wherein the aperture further comprises a two-dimensional shape that is one of rectangular, square, triangular, circular, curved, elliptical, quadrilateral, or polygon.

10. The apparatus of claim 1, wherein the planar conductor further comprises:

a first planar region and a second planar region that forms the planar conductor, wherein a non-conductive gap is disposed between opposing edges of the first planar region and the second planar region, and wherein a width of the non-conductive gap is minimized to provide a dipole mode for the antenna to radiate the signal.

11. The apparatus of claim 1, wherein the apparatus is arranged as a holographic metasurface antenna (HMA) that employs a plurality of the antennas as scattering antennas to radiate a beam based on the provided signal.

12. The apparatus of claim 1, wherein the fixed impedance value is provided by one or more of a metal wire, metallic trace, or extended segment of the planar conductor.

13. The apparatus of claim 1, wherein the fixed impedance value is provided by one or more of a resistor, capacitor, or inductor.

14. A method for controlling radiation of a signal, comprising:

providing an antenna that includes a planar conductor, wherein an aperture is formed in a portion of the planar conductor;

providing a variable component that is coupled between a middle of the aperture and a side of the aperture, wherein the variable component provides a variable impedance value;

providing a fixed component that is coupled between the middle of the aperture and an opposing side of the aperture, wherein the fixed component provides a fixed impedance value; and wherein in response to changing the variable impedance value to be non-equal to the fixed impedance value, a signal provided at the middle of the aperture is radiated by the antenna.

15. The method of claim 14, when the signal is radiated by the antenna, further comprising providing a 180 degree phase shift for the radiated signal based on which of the variable impedance value or the fixed impedance value is greater than each other.

16. The method of claim 14, further comprising:

providing a plurality of antennas, and wherein a distance between each planar conductor of each antenna is configured between one third and one eleventh of a wavelength of the signal radiated by the plurality of antennas, wherein the distance is provided to reduce mutual coupling between the plurality of antennas.

17. The method of claim 14, further comprising:

providing a plurality of patch antennas that are arranged on a circuit board for a wireless communication device, and wherein a length of each patch antenna is less than half of a length of a wavelength of the signal provided by the signal source.

18. The method of claim 14, further comprising:

employing a controller to perform actions, comprising:

varying the variable impedance value to match the fixed impedance value; and varying the variable impedance value to non-match the fixed impedance value.

19. The method of claim 14, further comprising:

providing a direct current (DC) ground that is coupled to the planar conductor, wherein the DC ground is arranged to provide a DC bias to improve one or more of impedance matching and radiation patterns for the antenna.

20. The method of claim 14, wherein the planar conductor further comprises:

a first planar region and a second planar region that forms the planar conductor, wherein a non-conductive gap is disposed between opposing edges of the first planar region and the second planar region, and wherein a width of the non-conductive gap is minimized to provide a dipole mode for the antenna to radiate the signal.

21. A processor readable non-transitory media that includes instructions, wherein execution of the instructions that are configured to cause actions, by one or more processors, enables performance of actions for controlling radiation of a signal, comprising:

providing an antenna that includes a planar conductor, wherein an aperture is formed in a portion of the planar conductor;

providing a variable component that is coupled between a middle of the aperture and a side of the aperture, wherein the variable component provides a variable impedance value;

providing a fixed component that is coupled between the middle of the aperture and an opposing side of the aperture, wherein the fixed component provides a fixed impedance value; and wherein in response to changing the variable impedance value to be non-equal to the fixed impedance value, a signal provided at the middle of the aperture is radiated by the antenna.

* * * * *